US009011107B2

(12) United States Patent
Field et al.

(10) Patent No.: US 9,011,107 B2
(45) Date of Patent: Apr. 21, 2015

(54) AIR COMPRESSOR SYSTEM AND METHOD OF OPERATION

(75) Inventors: Grant Andrew Field, Barellan Point (AU); Simo Tanner, Miami Beach, FL (US); Karl Ingmarsson, Gainesville, FL (US)

(73) Assignee: Sandvik Intellectual Property AB, Sandviken (SE)

( * ) Notice: Subject to any disclaimer, the term of this patent is extended or adjusted under 35 U.S.C. 154(b) by 775 days.

(21) Appl. No.: 13/090,046

(22) Filed: Apr. 19, 2011

(65) Prior Publication Data

US 2011/0286861 A1 Nov. 24, 2011

Related U.S. Application Data

(60) Provisional application No. 61/325,846, filed on Apr. 20, 2010, provisional application No. 61/378,718, filed on Aug. 31, 2010.

(51) Int. Cl.
*F04B 49/08* (2006.01)
*F04B 49/02* (2006.01)

(52) U.S. Cl.
CPC ..... *F04B 49/022* (2013.01)

(58) Field of Classification Search
CPC ..... F04B 49/022; F04B 49/06; F04B 49/065; F04B 49/08
USPC ..... 417/34, 44.2, 53
See application file for complete search history.

(56) References Cited

U.S. PATENT DOCUMENTS 3,395,855 A 8/1968 Clark
3,452,751 A 7/1969 Austin, Jr.
4,502,842 A * 3/1985 Currier et al. ..... 417/8

(Continued)

FOREIGN PATENT DOCUMENTS

CN 1656319 8/2005
CN 1766334 5/2006
CN 101163887 4/2008

OTHER PUBLICATIONS

International Search Report for International Application No. PCT/US2011/033074, dated Jun. 29, 2011.

(Continued)

*Primary Examiner* — Charles Freay
*Assistant Examiner* — Philip Stimpert
(74) *Attorney, Agent, or Firm* — Morgan, Lewis & Bockius LLP

(57) ABSTRACT

Air compressor systems, upgrade kits, computer readable medium, and methods for controlling an air compressor for improved performance. The methods may include receiving a working air requirement; determining an estimated air pressure of the air compressor to deliver the working air requirement; measuring a pressure of the air compressor; comparing the measured pressure with the calculated estimated air pressure; if the measured pressure of the air compressor is greater than the determined estimated air pressure by a predetermined greater amount, then decreasing an output control of the air compressor; and if the measured pressure of the air compressor is less than the calculated estimated air pressure by a predetermined lesser amount then increasing the output control of the air compressor. The air compressor may be controlled based on a measured pressure of delivered working air. An oil control system may shut off oil to parts of the air compressor.

10 Claims, 10 Drawing Sheets

(56) References Cited

U.S. PATENT DOCUMENTS

| | | | | |
|---|---|---|---|---|
| 4,653,593 | A | 3/1987 | Lindberg | |
| 4,793,421 | A | 12/1988 | Jasinski | |
| 4,850,806 | A | 7/1989 | Morgan et al. | |
| 4,924,949 | A | 5/1990 | Curlett | |
| 4,998,862 | A | 3/1991 | Hutchinson | |
| 5,019,470 | A | 5/1991 | Bugga et al. | |
| 5,249,635 | A | 10/1993 | King et al. | |
| 5,409,072 | A | 4/1995 | Enlund et al. | |
| 5,642,989 | A | 7/1997 | Keddie | |
| 5,873,420 | A | 2/1999 | Gearhart | |
| 5,944,122 | A | 8/1999 | Cheers | |
| 5,950,443 | A | 9/1999 | Meyer et al. | |
| 6,123,510 | A | 9/2000 | Greer et al. | |
| 6,637,522 | B2 | 10/2003 | Wilson et al. | |
| 6,644,931 | B2 | 11/2003 | Puech | |
| 6,860,730 | B2 | 3/2005 | Leppanen | |
| 6,981,855 | B2 | 1/2006 | Leppanen | |
| 7,476,088 | B2 | 1/2009 | Iimura et al. | |
| 7,503,409 | B2 * | 3/2009 | Brookover | 175/135 |
| 7,922,457 | B2 | 4/2011 | Lindsey et al. | |
| 2002/0001523 | A1 | 1/2002 | Tsuru et al. | |
| 2002/0021969 | A1 | 2/2002 | Totsuka | |
| 2003/0215338 | A1 | 11/2003 | Leppanen | |
| 2004/0173379 | A1 | 9/2004 | Leppanen | |
| 2007/0089907 | A1 | 4/2007 | Hartwig et al. | |
| 2007/0246262 | A1 | 10/2007 | Brookover | |
| 2008/0044299 | A1 | 2/2008 | Cobb | |
| 2008/0069703 | A1 | 3/2008 | Beckman | |
| 2009/0071715 | A1 | 3/2009 | Sormunen et al. | |
| 2010/0199950 | A1 | 8/2010 | Renner | |
| 2011/0255994 | A1 | 10/2011 | Field et al. | |
| 2011/0255995 | A1 | 10/2011 | Field et al. | |

OTHER PUBLICATIONS

International Search Report for International Application No. PCT/US2011/033064, dated Jun. 30, 2011.
International Search Report for International Application No. PCT/US2011/033084, dated Sep. 28, 2011.
Office Action for Australian Patent Application No. 2011242897, dated Oct. 25, 2013.
"State-of-the-art electronic monitoring and control capability", Atlas Copco Elektronikon system, www.atlascopco.com, Belgium.
"296-545 l/s, 17.8-32.7 $m^3$/min, 628-1155 cu.ft/min at 7-25 bar(e), 102-365 psig", Atlas Copco Portable Air Compressors, www.atlascopco.com, (2005), Belgium.
"Pit Viper 275", Atlas Copco Blasthole Drills, www.atlascopco.com, (Mar. 2010).
"The Cyclone™ Operating System", Atlas Copco Drilling Solutions LLC, Garland, TX www.atlascopco.com.
Office Action (with English translation) for Eurasian Patent Application No. 201291074/31, dated Jul. 30, 2014.
Office Action (with English translation) for Eurasian Patent Application No. 201291075/31, dated Jul. 30, 2014.
English translation of Office Action for Chinese Patent Application No. 201180020240.2, dated Mar. 27, 2014.
Office Action for Australian Patent Application No. 2011242892, dated Jun. 2, 2014.
Office Action for Australian Patent Application No. 2011242885, dated May 9, 2014.
English translation of Office Action for Chinese Patent Application No. 201180020209.9, dated Jun. 4, 2014.
Office Action for U.S. Appl. No. 13/090,025 dated Sep. 4, 2014.
English Translation of Office Action for Chinese Application No. 201180020314.2 dated Nov. 2, 2014.
Office Action for New Zealand Application No. 700785 dated Oct. 20, 2014.
Patent Examination Report No. 2 for Australian Patent Application No. 2011242897 dated Dec. 15, 2014.
Office Action Chilean Application No. 2012-002915 dated Nov. 24, 2014.
Office Action Chilean Application No. 2012-002916 dated Nov. 24, 2014.
Office Action Chilean Application No. 2012-002917 dated Nov. 24, 2014.
Second Office Action (with English Translation) for Chinese Application No. 201180020240.2 dated Dec. 1, 2014.

* cited by examiner

AIR COMPRESSOR SYSTEM AND METHOD OF OPERATION

CROSS-REFERENCE TO RELATED PATENT APPLICATION

This application claims the benefit of U.S. patent application Ser. No. 61/325,846, filed on Apr. 20, 2010, in the U.S. Patent and Trademark Office, the entire disclosure of which is incorporated herein by reference, and claims the benefit of U.S. patent application Ser. No. 61/378,718, filed on Aug. 31, 2010, in the U.S. Patent and Trademark Office, the entire disclosure of which is incorporated herein by reference.

FIELD

The present disclosure relates to an air compressor system and method of operation thereof and more particularly to an air compressor system and method of operation thereof that improves the operating efficiency of an air compressor system.

BACKGROUND

In the discussion of the background that follows, reference is made to certain structures and/or methods. However, the following references should not be construed as an admission that these structures and/or methods constitute prior art. Applicant expressly reserves the right to demonstrate that such structures and/or methods do not qualify as prior art.

Air compressors deliver a source of compressed air that may perform many useful functions. One example of where air compressors are used is for drilling rigs. Although the explanation that follows is limited to drilling rigs, it should be understood that the disclosed air compressor system and methods of operation thereof are not limited to drilling rigs. Some drilling rigs operate as follows. A drill bit of a drill string (which is one or more drill pipes connected together) is rotated to drill a hole in the ground, i.e., in earth and/or rock. In order to flush the cuttings from the hole as it is being drilled, an air compressor may be used to deliver pressurized air which is communicated downwardly through the drill string to the front face of the drill bit. The cuttings get caught in the airflow from the drill bit and are brought to the surface as the air travels upwardly along the exterior of the drill string. The pressurized air may also serve to cool the cutting elements of the drill bit. This is one way compressed air may be used by drilling rigs.

Compressed air may also be used in percussive drilling where the compressed air is used to reciprocate an impact piston which applies percussive blows from a piston to a rotating drill bit to enhance the cutting action. The piston may be disposed below the ground surface immediately above the drill bit (i.e., a so-called down-the-hole hammer), or it may be disposed on above the surface of the drill hole.

In many compressed air applications it is common to drive the air compressor by a engine (for example a fuel-driven engine or an electrically driven motor), which may also drive other equipment, such as a hydraulic system which may function to perform the following functions: power hydraulic systems to raise and lower the drill string, rotate the drill string via a gearbox, add drill rods to the drill string as drilling progresses, remove drill rods from the drill string as the drill string is being withdrawn from the hole, raise and lower a drilling mast, raise and lower leveling jacks, and propel the drilling rig (in the case of a mobile drilling rig). The engine also may drive a hydraulic pump and a cooling fan of a cooling system.

The compressed air needs of such a drilling machine are associated with the supplying of flushing air for flushing cuttings and/or driving the impact piston of a percussive tool and/or other accessories that may be used by the drilling rig. During operation of the drilling rig, there may be no need for pressurized air, such as during the adding or removal of drill rods, relocating the drill rig, setting up the drill rig, lunch breaks. Although there is no need during those periods to circulate compressed air to flush cuttings or to reciprocate the impact piston, it still may be necessary to drive the engine (that drives both the air compressor and the hydraulics) in order to continue to power the hydraulics.

In some air compressing systems, the drive connection between the air compressor and the engine is such that the air compressor is driven whenever the engine is driven, despite the fact that continuous operation of the air compressor is not necessary when drilling is not taking place.

There are certain measures that could be taken to further reduce the unnecessary consumption of energy. For example, a clutch could be provided between the engine and the air compressor to unload the compressor during periods of low air requirements, but that would add considerable cost to the equipment, and the clutch would rapidly wear in situations where the compressor has to be unloaded frequently. Additionally, it is uneconomical and impractical to switch the compressor on and off at frequent intervals. Moreover, even during periods where a large quantity of compressed air is not needed, smaller quantities may still be needed, so that the air compressor may have to cycle on and off to keep an air reservoir (a place where pressurized air from the air compressor may be stored) sufficiently pressurized for the smaller quantities.

Another possible energy-saving measure involves the provision of a variable speed gear drive for unloading the air compressor, but such a drive is complicated and relatively expensive, as would be a two-speed gear drive with clutches. With a variable speed gear drive, the revolutions per minute (RPMs) from the motor that are driving the air compressor could be reduced for reduced energy consumption.

Another possible measure involves driving the air compressor with a hydraulic motor that can be easily be stopped or slowed during periods of low pressure requirements. For example, when a drill rod is being added to the drill string. However, such drives are relatively inefficient (many are at most 80% efficient), so any energy savings realized during periods of low compressed air consumption would likely be lost during periods of high air compressed consumption.

Therefore, it would be desirable to provide an air compressing system employing an engine-driven air compressor which is energy efficient.

SUMMARY

An air compressor system is provided. The air compressor system including an air compressor having an air inlet and an air outlet, the air compressor configured to compress air from the air inlet and to deliver a volume of compressed air to the air outlet; an adjustable inlet valve configured to control an amount of air to the air inlet of the air compressor; a pressure sensor configured to measure an air pressure of the air compressor; a working air outlet valve in communication with the air outlet of the air compressor, the working air outlet configured to deliver at least some of the volume of compressed air from the air outlet of the air compressor as a working air when the working air outlet valve is open; and a controller in communication with the adjustable inlet valve and the pressure sensor, wherein the controller is configured to receive a working air requirement, and the controller is configured to adjust the adjustable inlet valve based on the measured air pressure of the air compressor compared with a calculated estimated air pressure for the air compressor to deliver the working air requirement.

The pressure sensor may measure the air pressure of the air inlet of the air compressor.

The pressure sensor may measure a vacuum inside the air compressor.

The controller may be configured to adjust the adjustable inlet valve to increase the amount of air to the air inlet of the air compressor when the measured air pressure is less than a predetermined lesser amount, and the controller is configured to adjust the adjustable inlet valve to decrease the amount of air to the air inlet of the air compressor, when the measured air pressure is greater than a predetermined greater amount.

The controller may be configured to calculate a setting for the adjustable air inlet valve to deliver the working air requirement based on stored information, and to adjust the adjustable air inlet to the calculated setting.

The working air requirement may be calculated based on receiving the following input: a drill pipe diameter, a drill bit diameter, and a desired up hole velocity of flushing air for a drill hole.

The air compressor system may include a working air pressure sensor configured to measure an air pressure of the delivered working air; wherein the controller is further configured to be in communication with the working air pressure sensor and configured to adjust the adjustable inlet valve based on the measured air pressure of the delivered working air compared with the working air requirement.

The working air pressure sensor may be located in a drill hole and measures a flushing air pressure.

The controller may be configured to adjust the adjustable inlet valve by calculating a running average of the measured air pressure of the delivered working air over a predetermined period of time and if the running average is less than the working air requirement more than a predetermined lesser amount then adjusting the adjustable inlet valve to increase the amount of air to the air inlet of the air compressor, and if the running average is greater than the desired flushing air pressure more than a predetermined greater amount then adjusting the adjustable inlet valve to decrease the amount of air to the air inlet of the air compressor.

The controller may be configured to stop adjusting the adjustable inlet valve based on the measured air pressure of the compressor after a predetermined amount of time.

The air compressor system may include a receiver having an air inlet and an air outlet, the receiver configured to store compressed air; a main air discharge passage connected to the air outlet of the air compressor and the air inlet of the receiver; a non-return valve disposed in the main air discharge passage between the air outlet of the air compressor and the air inlet of the receiver; a blow-down valve in communication with the receiver and configured to release the stored compressed air of the receiver when the blow-down valve is open; a receiver pressure sensor configured to measure an air pressure of the receiver; another non-return valve disposed in the secondary discharge passage; and wherein the working air outlet valve is in communication with the air outlet of the air compressor through the air outlet of the receiver, and wherein the controller is in communication with the receiver pressure sensor, and, the controller is configured to adjust the adjustable inlet valve to decrease the amount of air to the air inlet of the air compressor when the measured receiver pressure exceeds a predetermined maximum, and the controller is configured to adjust the adjustable inlet valve to increase the amount of air to the air inlet of the air compressor when the measured receiver pressure falls below a predetermined minimum.

In embodiments, the air compressor system does not include a minimum pressure valve disposed between the receiver and the working air outlet valve.

The air compressor system may include an engine driving the air compressor, the engine having a revolutions per minute (RPM); and a RPM sensor configured to measure the RMP of the engine, wherein the RPM sensor is in communication with the controller; and wherein the controller is configured to close the adjustable air inlet valve and open the blow-down valve during a start-up mode, wherein the start-up mode is defined as when the engine is started until the engine reaches a threshold number of RPMs.

The air compressor system may include a key in communication with the controller; and wherein in response to receiving an indication that a key has been turned off, the controller is configured to adjust the adjustable inlet valve to be closed and to open the blow-down valve.

The air compressor system may include a receiver having an air inlet and an air outlet, the receiver configured to store compressed air, wherein the working air outlet valve is in communication with the air outlet of the air compressor through the air outlet of the receiver; a main air discharge passage connected to the air outlet of the air compressor and the air inlet of the receiver; a non-return valve disposed in the main air discharge passage between the air outlet of the air compressor and the air inlet of the receiver; an evacuation pump having an air inlet and an air outlet, the air inlet of the evacuation pump being in communication with the air outlet of the air compressor to enable the evacuation pump to suck air out of the air compressor; a secondary discharge passage communicating the air outlet of the evacuation pump with the main air discharge passage downstream from the non-return valve; an evacuation pump isolation valve disposed between the air outlet of the air compressor and the air inlet of the evacuation pump and configured to have a closed position that isolates the air outlet of the air compressor from the air inlet of the evacuation pump and an open position where the air outlet of the air compressor is in communication with the air inlet of the evacuation pump; another non-return valve disposed in the secondary discharge passage; and wherein the controller is in communication with the evacuation pump and the evacuation pump isolation valve, and wherein the controller is configured to unload the air compressor by opening the evacuation pump isolation valve and closing the adjustable inlet valve.

The air compressor system may include a first oil line connected to the air compressor and the receiver, the first oil line configured to enable oil to flow from the receiver to the air compressor in the first oil line; a second oil line connected to the air compressor and the receiver, the second oil line configured to permit oil to flow from the receiver to the air compressor in the second oil line; and an oil stop valve disposed in the second oil line between the receiver and the air compressor, the oil stop valve configured to close the second oil line so that oil cannot flow through the second oil line when an air pressure at the air outlet of the air compressor falls below a predetermined oil opening pressure.

The first oil line may be configured to supply oil to bearing lube lines of the air compressor and the second oil line is configured to supply oil to cooling lines of the air compressor.

A method of controlling an air compressor is disclosed. The method includes in response to a working air being turned on, measuring a working air pressure, and adjusting an opening of an adjustable air inlet based on the measured working air pressure, the adjustable inlet valve configured to control an amount of air to an inlet of the air compressor; and in response to the working air being turned off, measuring a receiver air pressure, and adjusting the opening of the adjustable air inlet based on the measured receiver air pressure, the receiver configured to store air compressed by the air compressor.

The method may include in response to receiving a working air requirement, calculating a setting for the air inlet of the air compressor based on the working air requirement, and adjusting the air inlet of the air compressor using the calculated setting.

The method may include in response to receiving a working air requirement, calculating an air pressure for an air inlet of the air compressor based on the working air requirement, measuring the air pressure for the air inlet of the air compressor, adjusting the air inlet of the air compressor based on the calculated air pressure and the measured air pressure.

A method of controlling an air compressor is disclosed. The method including receiving a working air requirement; calculating an estimated air pressure of the air compressor for the air compressor to deliver the working air requirement; measuring a pressure of the air compressor; comparing the measured pressure of the air compressor with the calculated estimated air pressure; when the measured pressure of the air compressor is greater than the calculated estimated air pressure by a predetermined greater amount, then decreasing an opening of an adjustable inlet valve; and when the measured pressure of the air compressor is less than the calculated estimated air pressure by a predetermined lesser amount then increasing the opening of the adjustable inlet valve, the adjustable inlet valve configured to control an amount of air to an inlet of the air compressor.

Measuring a pressure of the air compressor may include measuring a pressure of the air compressor, wherein the measured pressure is a pressure inside of the air compressor.

The method may include measuring a delivered working air pressure; calculating a running average of a delivered working air pressure; comparing the calculated running average with the working air requirement; when the working air requirement is greater than the calculated running average by a second predetermined greater amount, then increasing the opening of an adjustable inlet valve; and when the working air requirement is less than the calculated running average by a second predetermined less amount then decreasing an opening of an adjustable inlet valve.

The method may include repeating the method as follows: before a predetermined amount of time has elapsed go back to the step that begins measuring a pressure of the air compressor; and after the predetermined amount of time has elapsed go back to the step that begins measuring a delivered working air pressure.

The method may include calculating a setting for the adjustable air inlet of the air compressor to deliver the working air requirement; and adjusting the adjustable air inlet to the calculated setting.

The method may include responsive to receiving an indication that the working air requirement is no longer needed, adjusting the opening of the adjustable inlet valve based on a receiver pressure, wherein the receiver is configured to store compressed air from the air compressor.

The method may include measuring an air pressure of a receiver, wherein the receiver is configured to store compressed air from the air compressor; comparing the measured air pressure of the receiver with a maximum value and a minimum value; when the measured air pressure of the receiver is greater than the maximum value then decreasing the opening of an adjustable inlet valve; and when the measured air pressure of the receiver is less than the minimum value then increasing the opening of an adjustable inlet valve.

An air compressor system is disclosed. The air compressor system includes an air compressor having an air inlet and an air outlet, the air compressor configured to compress air from the air inlet and to deliver a volume of compressed air to the air outlet; an adjustable inlet valve configured to control an amount of air to the air inlet of the air compressor; a working air outlet valve in communication with the air outlet of the air compressor, the working air outlet configured to deliver at least some of the volume of compressed air from the air outlet of the air compressor as a working air when the working air outlet valve is open; a receiver having an air inlet and an air outlet, the receiver configured to store compressed air, wherein the working air outlet valve is in communication with the air outlet of the air compressor through the air outlet of the receiver; a main air discharge passage connected to the air outlet of the air compressor and the air inlet of the receiver; a non-return valve disposed in the main air discharge passage between the air outlet of the air compressor and the air inlet of the receiver; an evacuation pump having an air inlet and an air outlet, the air inlet of the evacuation pump being in communication with the air outlet of the air compressor to enable the evacuation pump to suck air out of the air compressor; a secondary discharge passage communicating the air outlet of the evacuation pump with the main air discharge passage downstream from the non-return valve; an evacuation pump isolation valve disposed between the air outlet of the air compressor and the air inlet of the evacuation pump and configured to have a closed position that isolates the air outlet of the air compressor from the air inlet of the evacuation pump and an open position where the air outlet of the air compressor is in communication with the air inlet of the evacuation pump; another non-return valve disposed in the secondary discharge passage; a first oil line connected to the air compressor and the receiver, the first oil line configured to enable oil to flow from the receiver to the air compressor in the first oil line; a second oil line connected to the air compressor and the receiver, the second oil line configured to permit oil to flow from the receiver to the air compressor in the second oil line; and an oil stop valve disposed in the second oil line between the receiver and the air compressor, the oil stop valve configured to close the second oil line so that oil cannot flow through the second oil line when an air pressure at the air outlet of the air compressor falls below a predetermined oil opening pressure.

The first oil line may be configured to supply oil to bearing lube lines of the air compressor and the second oil line is configured to supply oil to cooling lines of the air compressor.

A controller may be in communication with the evacuation pump and the evacuation pump isolation valve, and wherein the controller is configured to unload the air compressor by opening the evacuation pump isolation valve, closing the adjustable inlet valve, and turning the evacuation pump on.

An air compressor system is disclosed. The air compressor system includes: an air compressor having an air inlet and an air outlet, the air compressor configured to compress air from the air inlet and to deliver a volume of compressed air to the air outlet; an adjustable inlet valve configured to control an amount of air to the air inlet of the air compressor; a working air pressure sensor configured to measure an air pressure of the delivered working air; a working air outlet valve in communication with the air outlet of the air compressor, the working air outlet configured to deliver at least some of the volume of compressed air from the air outlet of the air compressor as a working air when the working air outlet valve is open; and a controller in communication with the adjustable inlet valve and with the working air pressure sensor, wherein the controller is configured to receive a working air requirement, and configured to adjust the adjustable inlet valve based on the measured air pressure of the delivered working air compared with the working air requirement.

The controller may be configured to adjust the adjustable inlet valve by calculating a running average of the measured air pressure of the delivered working air over a predetermined period of time and if the running average is less than the working air requirement more than a predetermined lesser amount then adjusting the adjustable inlet valve to increase the amount of air to the air inlet of the air compressor, and if the running average is greater than the desired flushing air pressure more than a predetermined greater amount then adjusting the adjustable inlet valve to decrease the amount of air to the air inlet of the air compressor.

The controller may be configured to adjust the adjustable inlet valve to increase the amount of air to the air inlet of the air compressor when the measured air pressure of the delivered working air is less than a predetermined lesser amount, and the controller is configured to adjust the adjustable inlet valve to decrease the amount of air to the air inlet of the air compressor, when the measured air pressure of the delivered working air is greater than a predetermined greater amount.

The controller may further configured to calculate a setting for the adjustable air inlet valve to deliver the working air requirement based on stored information, and to adjust the adjustable air inlet to the calculated setting.

The working air requirement may be calculated based on receiving the following input: a drill pipe diameter, a drill bit diameter, and a desired up hole velocity of flushing air for a drill hole.

The working air pressure sensor may be located in a drill hole and measures a flushing air pressure.

A method of controlling an air compressor is disclosed. The method of controlling an air compressor including receiving a working air requirement; adjusting an adjustable air inlet; measuring a delivered working air pressure; comparing the measured delivered working air pressure with the working air requirement; when the working air requirement is greater than the measured delivered working air pressure by a second predetermined greater amount, then increasing the opening of an adjustable inlet valve; and when the working air requirement is less than the measured delivered working air pressure by a second predetermined less amount then decreasing an opening of an adjustable inlet valve.

The method may include calculating a running average of a delivered working air pressure; comparing the calculated running average with the working air requirement; when the working air requirement is greater than the calculated running average by a second predetermined greater amount, then decreasing the opening of an adjustable inlet valve; and when the working air requirement is less than the calculated running average by a second predetermined less amount then increasing an opening of an adjustable inlet valve.

The method may include calculating a setting for the adjustable air inlet of the air compressor to deliver the working air requirement; and adjusting the adjustable air inlet to the calculated setting.

The method may include calculating an estimated air pressure of the air compressor for the air compressor to deliver the working air requirement; measuring a pressure of the air compressor; comparing the measured pressure of the air compressor with the calculated estimated air pressure; when the measured pressure of the air compressor is greater than the calculated estimated air pressure by a predetermined greater amount, then decreasing an opening of an adjustable inlet valve; and when the measured pressure of the air compressor is less than the calculated estimated air pressure by a predetermined lesser amount then increasing the opening of the adjustable inlet valve, the adjustable inlet valve configured to control an amount of air to an inlet of the air compressor.

Measuring a pressure of the air compressor may include measuring a pressure of the air compressor, wherein the measured pressure is a pressure inside the air compressor.

An air compressor system is disclosed. The air compressor system includes: an air compressor having an air inlet and an air outlet, the air compressor configured to compress air from the air inlet and to deliver a volume of compressed air to the air outlet; an output control configured to control an amount of air compressed by the air compressor; a pressure sensor configured to measure an air pressure of the air compressor; a working air outlet valve in communication with the air outlet of the air compressor, the working air outlet configured to deliver at least some of the volume of compressed air from the air outlet of the air compressor as a working air when the working air outlet valve is open; and a controller in communication with the output control and the pressure sensor, wherein the controller is configured to receive a working air requirement, and the controller is configured to adjust the output control based on the measured air pressure of the air compressor compared with a calculated estimated air pressure for the air compressor to deliver the working air requirement.

The controller may be configured to adjust the output control of the air compressor by at least one of: adjusting an opening of an adjustable inlet valve, adjusting an RPM of an engine, and adjusting a clutch control.

The pressure sensor may measure the air pressure of the air inlet of the air compressor.

The pressure sensor may measure a vacuum inside the air compressor.

The controller may be configured to adjust the output control to increase the amount of air to the air inlet of the air compressor when the measured air pressure is less than a predetermined lesser amount, and the controller is configured to adjust the output control to decrease the amount of air to the air inlet of the air compressor, when the measured air pressure is greater than a predetermined greater amount.

The controller may further configured to calculate a setting for the output control to deliver the working air requirement based on stored information, and to adjust the output control to the calculated setting.

The working air requirement may be calculated based on receiving the following input: a drill pipe diameter, a drill bit diameter, and a desired up hole velocity of flushing air for a drill hole.

The air compressor system may include a working air pressure sensor configured to measure an air pressure of the delivered working air; wherein the controller is further configured to be in communication with the working air pressure sensor and configured to adjust the output control based on the measured air pressure of the delivered working air compared with the working air requirement.

The working air pressure sensor may be located in a drill hole and measures a flushing air pressure.

The controller may be configured to adjust the output control by calculating a running average of the measured air pressure of the delivered working air over a predetermined period of time and if the running average is less than the working air requirement more than a predetermined lesser amount then adjusting the output control to increase the amount of air produced by the air compressor, and if the running average is greater than the desired flushing air pressure more than a predetermined greater amount then adjusting the output control to decrease the amount of air produced by the air compressor.

The controller may be configured to stop adjusting the output control based on the measured air pressure of the compressor after a predetermined amount of time.

The air compressor system may include a receiver having an air inlet and an air outlet, the receiver configured to store compressed air; a main air discharge passage connected to the air outlet of the air compressor and the air inlet of the receiver; a non-return valve disposed in the main air discharge passage between the air outlet of the air compressor and the air inlet of the receiver; a blow-down valve in communication with the receiver and configured to release the stored compressed air of the receiver when the blow-down valve is open; a receiver pressure sensor configured to measure an air pressure of the receiver; another non-return valve disposed in the secondary discharge passage; and wherein the working air outlet valve is in communication with the air outlet of the air compressor through the air outlet of the receiver, and wherein the controller is in communication with the receiver pressure sensor, and, the controller is configured to adjust the output control to decrease the amount of air produced by the air compressor when the measured receiver pressure exceeds a predetermined maximum, and the controller is configured to adjust the output control to increase the amount of air produced by the air compressor when the measured receiver pressure falls below a predetermined minimum.

In embodiments, the air compressor system does not include a minimum pressure valve disposed between the receiver and the working air outlet valve.

The air compressor system may include an engine driving the air compressor, the engine having a revolutions per minute (RPM); and a RPM sensor configured to measure the RMP of the engine, wherein the RPM sensor is in communication with the controller; and wherein the controller is configured to close the output control and open the blow-down valve during a start-up mode, wherein the start-up mode is defined as when the engine is started until the engine reaches a threshold number of RPMs.

The air compressor system may include a key in communication with the controller; and wherein in response to receiving an indication that a key has been turned off, the controller is configured to adjust the output control to be closed so the air compressor is not producing compressed air and to open the blow-down valve.

The air compressor system may include a receiver having an air inlet and an air outlet, the receiver configured to store compressed air, wherein the working air outlet valve is in communication with the air outlet of the air compressor through the air outlet of the receiver; a main air discharge passage connected to the air outlet of the air compressor and the air inlet of the receiver; a non-return valve disposed in the main air discharge passage between the air outlet of the air compressor and the air inlet of the receiver; an evacuation pump having an air inlet and an air outlet, the air inlet of the evacuation pump being in communication with the air outlet of the air compressor to enable the evacuation pump to suck air out of the air compressor; a secondary discharge passage communicating the air outlet of the evacuation pump with the main air discharge passage downstream from the non-return valve; an evacuation pump isolation valve disposed between the air outlet of the air compressor and the air inlet of the evacuation pump and configured to have a closed position that isolates the air outlet of the air compressor from the air inlet of the evacuation pump and an open position where the air outlet of the air compressor is in communication with the air inlet of the evacuation pump; another non-return valve disposed in the secondary discharge passage; and wherein the controller is in communication with the evacuation pump and the evacuation pump isolation valve, and wherein the controller is configured to unload the air compressor by opening the evacuation pump isolation valve and closing the adjustable inlet valve.

The air compressor system may include a first oil line connected to the air compressor and the receiver, the first oil line configured to enable oil to flow from the receiver to the air compressor in the first oil line; a second oil line connected to the air compressor and the receiver, the second oil line configured to permit oil to flow from the receiver to the air compressor in the second oil line; and an oil stop valve disposed in the second oil line between the receiver and the air compressor, the oil stop valve configured to close the second oil line so that oil cannot flow through the second oil line when an air pressure at the air outlet of the air compressor falls below a predetermined oil opening pressure.

The first oil line may be configured to supply oil to bearing lube lines of the air compressor and the second oil line is configured to supply oil to cooling lines of the air compressor.

The controller may be configured to adjust the working air requirement based on a depth of a drill bit, wherein the depth of the drill bit is received from at least one of: a depth sensor configured to measure a depth of a drill bit in a drill hole, or an input device configured to receive an indication of the depth of the drill bit.

The controller may be further configured to reduce the working air requirement for at least one of: a brief period of time or a brief distance of drilling.

The controller may be further configured to adjust the output control to maintain a minimum pressure at the working air outlet valve if the working air outlet valve is open.

A method of controlling an air compressor is disclosed. The method includes: in response to a working air being turned on, measuring a working air pressure, and adjusting an output control of the air compressor based on the measured working air pressure; and in response to the working air being turned off, measuring a receiver air pressure, and adjusting the output control of the air compressor based on the measured receiver air pressure, the receiver configured to store air compressed by the air compressor.

Adjusting an output control of the air compressor based on the measured working air pressure may include adjusting at least one of: an opening of an adjustable inlet valve, an RPM of an engine, and a clutch control based on the measured working air pressure; and wherein adjusting the output control of the air compressor based on the measured receiver air pressure, comprises: adjusting at least one of: an opening of an adjustable inlet valve, an RPM of an engine, and a clutch control based on the measured receiver air pressure, the receiver configured to store air compressed by the air compressor.

The method may include in response to receiving a working air requirement, calculating a setting for the output control of the air compressor based on the working air requirement, and adjusting the output control of the air compressor using the calculated setting.

The method may include in response to receiving a working air requirement, calculating a air pressure for an air inlet of the air compressor based on the working air requirement, measuring the air pressure for the air inlet of the air compressor, adjusting the output control of the air compressor based on the calculated air pressure and the measured air pressure.

Measuring a working air pressure may include measuring a working air pressure by determining a running average of the working air pressure.

The method may include adjusting the working air requirement based on a depth of a drill bit.

A method of controlling an air compressor. The method including receiving a working air requirement; calculating an estimated air pressure of the air compressor for the air compressor to deliver the working air requirement; measuring a pressure of the air compressor; comparing the measured pressure of the air compressor with the calculated estimated air pressure; if the measured pressure of the air compressor is greater than the calculated estimated air pressure by a predetermined greater amount, then decreasing an output control of the air compressor; and if the measured pressure of the air compressor is less than the calculated estimated air pressure by a predetermined lesser amount then increasing the output control of the air compressor.

Decreasing an output control of the air compressor may include at least one of: decreasing an opening of an adjustable inlet valve, lowering an RPM of an engine, and decreasing a clutch control, and wherein increasing an output control of the air compressor comprises at least one of: increasing an opening of an adjustable inlet valve, increasing an RPM of the engine, and increasing a clutch control.

Measuring a pressure of the air compressor may include measuring a pressure of the air compressor, wherein the measured pressure is a pressure inside of the air compressor.

The method may include measuring a delivered working air pressure; calculating a running average of a delivered working air pressure; comparing the calculated running average with the working air requirement; if the working air requirement is greater than the calculated running average by a second predetermined greater amount, then increasing the output control; and if the working air requirement is less than the calculated running average by a second predetermined less amount then decreasing an output control.

The method may include repeating the method as follows: before a predetermined amount of time has elapsed go back to the step that begins measuring a pressure of the air compressor; and after the predetermined amount of time has elapsed go back to the step that begins measuring a delivered working air pressure.

The method may include calculating a setting for the output control to deliver the working air requirement; and adjusting the output control to the calculated setting.

The method may include responsive to receiving an indication that the working air requirement is no longer needed, adjusting the output control based on a receiver pressure, wherein the receiver is configured to store compressed air from the air compressor.

The method may include measuring an air pressure of a receiver, wherein the receiver is configured to store compressed air from the air compressor; comparing the measured air pressure of the receiver with a maximum value and a minimum value; when the measured air pressure of the receiver is greater than the maximum value then decreasing the output control; and when the measured air pressure of the receiver is less than the minimum value then increasing the output control.

If the measured pressure of the air compressor is greater may include if the measured pressure of the air compressor is greater than the calculated estimated air pressure by a predetermined greater amount and a measured pressure of the air compressor is greater than a minimum pressure for a minimum working air pressure, then decreasing the output control of the air compressor.

The method may include increasing the working air requirement based on a depth of a drill bit.

The method may include reducing the working air requirement for at least one of: a brief period of time or a brief distance of drilling.

An air compressor system is disclosed. The air compressor system includes an air compressor having an air inlet and an air outlet, the air compressor configured to compress air from the air inlet and to deliver a volume of compressed air to the air outlet; an output control configured to control an amount of air compressed by the air compressor; a working air outlet valve in communication with the air outlet of the air compressor, the working air outlet configured to deliver at least some of the volume of compressed air from the air outlet of the air compressor as a working air when the working air outlet valve is open; a receiver having an air inlet and an air outlet, the receiver configured to store compressed air, wherein the working air outlet valve is in communication with the air outlet of the air compressor through the air outlet of the receiver; a main air discharge passage connected to the air outlet of the air compressor and the air inlet of the receiver; a first oil line connected to the air compressor and the receiver, the first oil line configured to enable oil to flow from the receiver to the air compressor in the first oil line; a second oil line connected to the air compressor and the receiver, the second oil line configured to permit oil to flow from the receiver to the air compressor in the second oil line; and an oil stop valve disposed in the second oil line between the receiver and the air compressor, the oil stop valve configured to close the second oil line so that oil cannot flow through the second oil line.

The oil stop valve may be configured to close the second oil line so that oil cannot flow through the second oil line when an air pressure at the air outlet of the air compressor falls below a predetermined oil opening pressure.

The oil stop valve may be configured to close the second oil line so that oil cannot flow through the second oil line based on receiving a signal from a controller.

The air compressor system may include a non-return valve disposed in the main air discharge passage between the air outlet of the air compressor and the air inlet of the receiver; an evacuation pump having an air inlet and an air outlet, the air inlet of the evacuation pump being in communication with the air outlet of the air compressor to enable the evacuation pump to suck air out of the air compressor; a secondary discharge passage communicating the air outlet of the evacuation pump with the main air discharge passage downstream from the non-return valve; an evacuation pump isolation valve disposed between the air outlet of the air compressor and the air inlet of the evacuation pump and configured to have a closed position that isolates the air outlet of the air compressor from the air inlet of the evacuation pump and an open position where the air outlet of the air compressor is in communication with the air inlet of the evacuation pump; and another non-return valve disposed in the secondary discharge passage.

The first oil line may be configured to supply oil to bearing lube lines of the air compressor and the second oil line is configured to supply oil to cooling lines of the air compressor.

A controller may be in communication with the evacuation pump and the evacuation pump isolation valve, and wherein the controller may be configured to unload the air compressor by opening the evacuation pump isolation valve, closing the adjustable inlet valve, and turning the evacuation pump on.

An air compressor system is disclosed. The air compressor system may include an air compressor having an air inlet and an air outlet, the air compressor configured to compress air from the air inlet and to deliver a volume of compressed air to the air outlet; an output control configured to control an amount of air compressed by the air compressor; a working air pressure sensor configured to measure an air pressure of the delivered working air; a working air outlet valve in communication with the air outlet of the air compressor, the working air outlet configured to deliver at least some of the volume of compressed air from the air outlet of the air compressor as a working air when the working air outlet valve is open; and a controller in communication with the adjustable inlet valve and with the working air pressure sensor, wherein the controller is configured to receive a working air requirement, and configured to adjust the output control based on the measured air pressure of the delivered working air compared with the working air requirement.

The controller may be configured to adjust the output control of the air compressor by at least one of: adjusting an opening of an adjustable inlet valve, adjusting an RPM of an engine, and adjusting a clutch control.

The controller may be configured to adjust the output control by calculating a running average of the measured air pressure of the delivered working air over a predetermined period of time and if the running average is less than the working air requirement more than a predetermined lesser amount then adjusting the output control to increase the amount of air to the air inlet of the air compressor, and if the running average is greater than the desired flushing air pressure more than a predetermined greater amount then adjusting the output control to decrease the amount of air to the air inlet of the air compressor.

The controller may be configured to adjust the output control to increase the amount of air produced by the air compressor when the measured air pressure of the delivered working air is less than a predetermined lesser amount, and the controller is configured to adjust the output control to decrease the amount of air produced by the air compressor, when the measured air pressure of the delivered working air is greater than a predetermined greater amount.

The controller may be configured to calculate a setting for the output control to deliver the working air requirement based on stored information, and to adjust the output control to the calculated setting.

The working air requirement may be calculated based on receiving the following input: a drill pipe diameter, a drill bit diameter, and a desired up hole velocity of flushing air for a drill hole.

The working air pressure sensor may be located in a drill hole and measures a flushing air pressure.

The controller may be further configured to adjust the working air requirement based on a depth of a drill bit, wherein the depth of the drill bit is received from at least one of: a depth sensor configured to measure a depth of a drill bit in a drill hole, or an input device configured to receive an indication of the depth of the drill bit.

The controller may be configured to reduce the working air requirement for at least one of: a brief period of time or a brief distance of drilling.

The controller may be configured to adjust the output control to maintain a minimum pressure for the delivered working air outlet valve if the working air outlet valve is open.

A method of controlling an air compressor is disclosed. The method includes receiving a working air requirement; adjusting an output control of the air compressor; measuring a delivered working air pressure; comparing the measured delivered working air pressure with the working air requirement; if the working air requirement is greater than the measured delivered working air pressure by a first predetermined greater amount, then increasing the output control of the air compressor; and if the working air requirement is less than the measured delivered working air pressure by a second predetermined less amount then decreasing the output control of the air compressor.

The output control of the air compressor may include increasing at least one of: an opening of an adjustable inlet valve, an RPM of an engine, and a clutch control; and wherein decreasing the output control of the air compressor, comprises: decreasing at least one of: an opening of an adjustable inlet valve, an RPM of an engine, and a clutch control.

The method may include calculating a running average of a delivered working air pressure; comparing the calculated running average with the working air requirement; if the working air requirement is greater than the calculated running average by a second predetermined greater amount, then decreasing the output control; and if the working air requirement is less than the calculated running average by a second predetermined less amount then increasing an output control.

The method may include calculating a setting for the output control of the air compressor to deliver the working air requirement; and adjusting the output control to the calculated setting.

The method may include calculating an estimated air pressure of the air compressor for the air compressor to deliver the working air requirement; measuring a pressure of the air compressor; comparing the measured pressure of the air compressor with the calculated estimated air pressure; if the measured pressure of the air compressor is greater than the calculated estimated air pressure by a predetermined greater amount, then decreasing the output control; and if the measured pressure of the air compressor is less than the calculated estimated air pressure by a predetermined lesser amount then increasing the output control.

Measuring a pressure of the air compressor may include measuring a pressure of the air compressor, wherein the measured pressure is a pressure inside the air compressor.

A computer program product is disclosed. The computer program product includes a computer-readable medium comprising: a first set of codes for causing a computer to calculate an estimated air pressure of the air compressor for the air compressor to deliver a working air requirement; a second set of codes for causing a computer to measure a pressure of the air compressor; a third set of codes for causing a computer to compare the measured pressure of the air compressor with the calculated estimated air pressure; a fourth set of codes for causing a computer to decrease an opening of an adjustable inlet valve if the measured pressure of the air compressor is greater than the calculated estimated air pressure by a predetermined greater amount; a fourth set of codes for causing a computer to increase the opening of the adjustable inlet valve, if the measured pressure of the air compressor is less than the calculated estimated air pressure by a predetermined lesser amount, wherein the adjustable inlet valve configured to control an amount of air to an inlet of the air compressor.

An air compressor system upgrade kit, for an air compressor system comprising: an air inlet and an air outlet, the air compressor configured to compress air from the air inlet and to deliver a volume of compressed air to the air outlet; a working air outlet valve in communication with the air outlet of the air compressor, the working air outlet configured to deliver at least some of the volume of compressed air from the air outlet of the air compressor as a working air when the working air outlet valve is open; the air compressor system upgrade kit including a controller configurable to communicate with an output control for controlling an amount of air compressed by the air compressor and a pressure sensor, wherein the controller is configured to receive a working air requirement, and the controller is configured to adjust the output control based on the measured air pressure of the air compressor compared with a calculated estimated air pressure for the air compressor to deliver the working air requirement.

The output control is an adjustable inlet valve configurable to control an amount of air to the air inlet of the air compressor; and the air compressor system upgrade kit further may include a pressure sensor configurable to measure an air pressure of the air compressor.

An air compressor system upgrade kit is disclosed. The air compressor upgrade kit including an air compressor having an air inlet and an air outlet, the air compressor configured to compress air from the air inlet and to deliver a volume of compressed air to the air outlet; an output control configured to control an amount of air compressed by the air compressor; a working air outlet valve in communication with the air outlet of the air compressor, the working air outlet configured to deliver at least some of the volume of compressed air from the air outlet of the air compressor as a working air when the working air outlet valve is open; a receiver having an air inlet and an air outlet, the receiver configured to store compressed air, wherein the working air outlet valve is in communication with the air outlet of the air compressor through the air outlet of the receiver; a main air discharge passage connected to the air outlet of the air compressor and the air inlet of the receiver; a non-return valve disposed in the main air discharge passage between the air outlet of the air compressor and the air inlet of the receiver; said air compressor system upgrade kit comprising: instructions for configuring a first oil line connected to the air compressor and the receiver, the first oil line configured to enable oil to flow from the receiver to the air compressor in the first oil line; instructions for configuring a second oil line connected to the air compressor and the receiver, the second oil line configured to permit oil to flow from the receiver to the air compressor in the second oil line; and an oil stop valve configurable to be disposed in the second oil line between the receiver and the air compressor, the oil stop valve configurable to close the second oil line so that oil cannot flow through the second oil line when an air pressure at the air outlet of the air compressor falls below a predetermined oil opening pressure.

A method for controlling oil in an air compressor system is disclosed. The method including opening an evacuation pump isolation valve disposed between the air outlet of the air compressor and an air inlet of an evacuation pump and configured to have a closed position that isolates the air outlet of the air compressor from the air inlet of the evacuation pump and an open position where the air outlet of the air compressor is in communication with the air inlet of the evacuation pump; sucking air out of an air compressor with an evacuation pump having an air inlet and an air outlet, the air inlet of the evacuation pump being in communication with the air outlet of the air compressor; flowing oil through a first oil line connected to the air compressor and a receiver, the first oil line configured to enable oil to flow from the receiver to the air compressor in the first oil line; flowing oil through a second oil line connected to the air compressor and the receiver, the second oil line configured to permit oil to flow from the receiver to the air compressor in the second oil line; and if an air pressure of the air compressor falls below a predetermined oil open pressure, closing an oil stop valve disposed in the second oil line between the receiver and the air compressor, so that oil cannot flow through the second oil line.

The first oil line may be for lubricating the compressor and the second line is for cooling the compressor.

A drilling rig is disclosed. The drilling rig may be configured to control an air compressor system according to at least one of the methods disclosed herein.

A computer program product is disclosed. The computer program product may include a computer-readable medium, which includes: a first set of codes for causing a computer to calculate an estimated air pressure of the air compressor for the air compressor to deliver a working air requirement; a second set of codes for causing a computer to measure a pressure of the air compressor; a third set of codes for causing a computer to compare the measured pressure of the air compressor with the calculated estimated air pressure; a fourth set of codes for causing a computer to decrease an output control configured to control an amount of air compressed by the air compressor if the measured pressure of the air compressor is greater than the calculated estimated air pressure by a predetermined greater amount; and a fourth set of codes for causing a computer to increase the output control, if the measured pressure of the air compressor is less than the calculated estimated air pressure by a predetermined lesser amount.

A computer program product is disclosed. The computer program product may include a computer-readable medium, which includes a first set of codes for causing a computer to measure a working air pressure in response to a working air being turned on; a second set of codes for causing a computer to adjust an output control configured to control an amount of air compressed by the air compressor based on the measured working air pressure; a third set of codes for causing a computer to measure a receiver air pressure in response to the working air being turned off; and a fourth set of codes for measuring a receiver air pressure and adjusting the output control of the air compressor based on the measured receiver air pressure, the receiver configured to store air compressed by the air compressor.

A computer program product is disclosed. The computer program product may include a computer-readable medium, which includes: a first set of codes for causing a computer to adjust an output control configured to control an amount of air compressed by the air compressor in response to receiving a working air requirement; a second set of codes for causing a computer to measure a delivered working air pressure; a third set of codes for causing a computer to compare the measured delivered working air pressure with the working air requirement; a forth set of codes for causing a computer to increase the output control if the working air requirement is greater than the measured delivered working air pressure by a second predetermined greater amount; and fifth set of codes for causing a computer to decrease the output control if the working air requirement is less than the measured delivered working air pressure by a second predetermined less amount.

A method for controlling oil in an air compressor system is disclosed. The method includes: flowing oil through a first oil line connected to the air compressor and a receiver, the first oil line configured to enable oil to flow from the receiver to the air compressor in the first oil line; flowing oil through a second oil line connected to the air compressor and the receiver, the second oil line configured to permit oil to flow from the receiver to the air compressor in the second oil line; and if an air pressure of the air compressor falls below a predetermined oil open pressure, closing an oil stop valve disposed in the second oil line between the receiver and the air compressor, so that oil cannot flow through the second oil line.

An air compressor system upgrade kit is disclosed. The air compressor system includes an air inlet and an air outlet, the air compressor configured to compress air from the air inlet and to deliver a volume of compressed air to the air outlet; a working air outlet valve in communication with the air outlet of the air compressor, the working air outlet configured to deliver at least some of the volume of compressed air from the air outlet of the air compressor as a working air when the working air outlet valve is open. The air compressor system upgrade kit includes a controller configurable to communicate with an output control for controlling an amount of air compressed by the air compressor and a pressure sensor, wherein the controller is configured to receive a working air requirement, and configured to adjust the output control based on the measured air pressure of the delivered working air compared with the working air requirement.

It is to be understood that both the foregoing general description and the following detailed description are exemplary and explanatory and are intended to provide further explanation of the invention as claimed.

BRIEF DESCRIPTION OF THE DRAWING

The following detailed description can be read in connection with the accompanying drawings in which like numerals designate like elements and in which.

DETAILED DESCRIPTION

Therefore there is a need in the art for an air compressor system and methods of operating air compressor systems. The air compressor system including an air compressor having an air inlet and an air outlet, the air compressor configured to compress air from the air inlet and to deliver a volume of compressed air to the air outlet; a output control configured to control an amount of air compressed by the air compressor; a pressure sensor configured to measure an air pressure of the air compressor; a working air outlet valve in communication with the air outlet of the air compressor, the working air outlet configured to deliver at least some of the volume of compressed air from the air outlet of the air compressor as a working air when the working air outlet valve is open; and a controller in communication with the adjustable inlet valve and the pressure sensor, wherein the controller is configured to receive a working air requirement, and the controller is configured to adjust the output control based on the measured air pressure of the air compressor compared with a calculated estimated air pressure for the air compressor to deliver the working air requirement.

Figure 1:
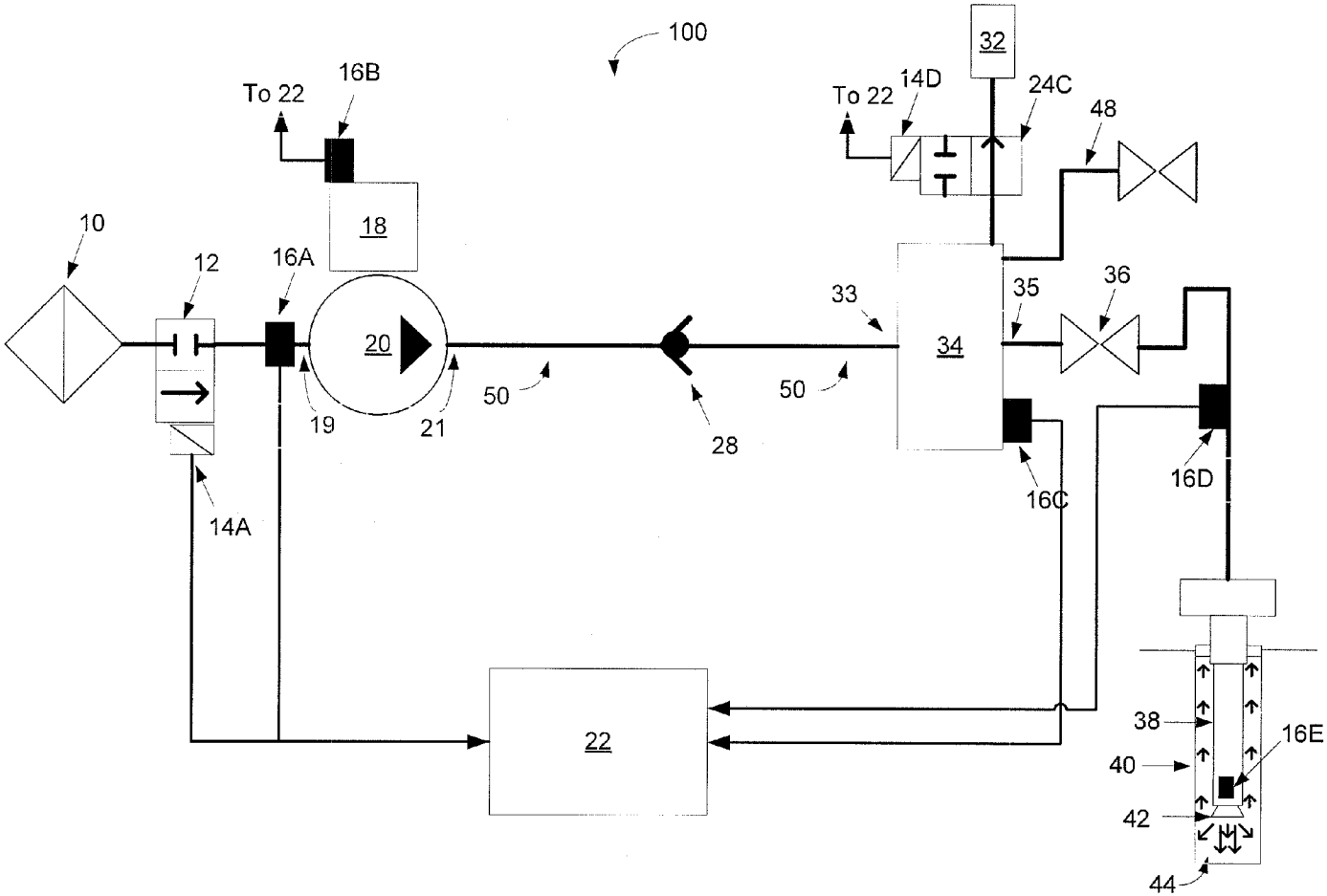
FIG. 1 is an example of an air compressor system.

FIG. 1 illustrates an example of an air compressor system. The air compressor system 100 takes air in through an air filter 10 and compresses the air with an air compressor 20 and delivers the compressed air as working air 44 which in this example is flushing air 44 for a drilling rig operation.

The basic components of the air compressor system 100 may include an air filter 10, an adjustable inlet valve 12, a solenoid 14A (to control the adjustable inlet valve 12), a pressure sensor 16A, an engine 18, a revolutions per minute (RPMs) sensor 16B, an air compressor 20, an air inlet of the compressor 19, an air outlet of the compressor 21, a controller 22, a primary discharge passage 50, a non-return valve 28, a receiver 34, an air inlet of the receiver 33, an air outlet of the receiver 35, a receiver pressure sensor 16C, a working air outlet valve 36, an accessory compressed air supply line 48, a blow-down valve 24C, a solenoid 14D (to control the blow-down valve 24C), a muffler 32, a working air outlet valve 36, a flushing air pressure sensor 16D, a depth sensor 16E, and an input device (not illustrated) for receiving input from a user of the air compressor system 100.

The air filter 10 may be a filter to filter air. The adjustable inlet valve 12 may be an inlet butterfly valve. The adjustable inlet valve 12 may be biased by a spring to be in a default state of closed. The solenoid 14A may be disposed to adjust the adjustable inlet valve 12 to open an adjustable amount to change an amount of air that can flow to the air inlet of the air compressor 19. The solenoid 14A (to control the adjustable inlet valve 12) may be an electrical device that produces a magnetic field when current is applied. The adjustable inlet valve may also be operated by an electrical, hydraulic, or pneumatic actuator in communication with the controller 22. The solenoid 14A may be in electrical communication with the controller 22. The pressure sensor 16A may be a transducer for converting pressure into an electrical signal. The pressure sensor 16A may be in electrical communication with the controller 22. The pressure sensor 16A may be located in or near the air compressor 20. The engine 18 may be an electric engine or a gasoline motor or a hydraulic motor. The revolutions per minute (RPMs) sensor 16B may be transducer converting the RPMs of the engine 18 into an electrical signal. The RPMs sensor 16B may be in electrical communication with the controller 22 and may indicate ranges for the RPMs. (For example, a signal that indicates the engine 18 is off or the engine 18 is in a low RPM state.) The air compressor 20 may be a screw air compressor. The air inlet 19 of the air compressor 20 may be an air inlet 19 of the air compressor 20. The air outlet 21 of the air compressor 20 may be an air outlet 21 of the air compressor 20. The controller 22 may be a programmable logic controller (PLC). The controller 22 may be in electrical communication with the solenoids 14A and 14D. The controller 22 may be in electrical communication with the sensors 16A, 16B, 16C, 16D. The controller 22 is configured to control the operation of the air compressor system 100.

The primary discharge passage 50 may be an air pipe constructed out a suitable material for conveying compressed air and oil. The non-return valve 28 may be a valve which allows air and oil to flow through it in only one direction from the air compressor 20 to the receiver 34. The receiver 34 may be an air receiver constructed of suitable material for storing compressed air and for filtering oil from the air compressor 24. The air inlet of the receiver 33 may be an air inlet of the receiver 34. The air outlet of the receiver 35 may be an air outlet of the receiver 35. The receiver pressure sensor 16C may be a transducer for converting the pressure of the receiver 35 into an electrical signal. The receiver pressure sensor 16C may be in electrical communication with the controller 22. A working air outlet valve 36 may be an air valve operable by a user of the air compressor system 100. The working air outlet valve 36 may communicate the compressed air from the air outlet of the receiver 35 with a working air application which here is flushing air 44. The accessory compressed air supply line 48 may be an air line in communication with the receiver 34 that may supply compressed air to accessories that need compressed air. The blow-down valve 24C may be an electrically controlled air value having two positions: a open position as a default and a closed position that the blow-down valve 14B switches to when current is applied to the solenoid 14D. The solenoid 14D (to control the blow-down valve 24C) may be an electrical device that produces a magnetic field when current is applied. The solenoid 14B may be in electrical communication with the controller 22. The muffler 32 may be shaped to muffle sound from the escape of compressed air from the receiver 34. The flushing air pressure sensor 16D may be a transducer for converting the pressure of the flushing air 44 into an electrical signal. The flushing air pressure sensor 16D may be in electrical communication with the controller 22. The flushing air pressure sensor 16D may be located in a pipe above ground that is delivering the flushing air 44. Alternatively, the flushing air pressure sensor 16D may be located in the hole near the flushing air 44. The depth sensor 16E may be a transducer for converting the depth of the drill bit 42 into an electrical signal. The depth sensor 16E may be in electrical communication with the controller 22. The depth sensor 16E may be located near the drill bit 42. In embodiments, the depth sensor 16E is a laser depth counter. In embodiments, an operator determines the depth and enters the depth information which is used by the controller 22. Alternatively, the depth sensor 16E may be a located on the drilling rig. The depth sensor 16E may count either automatically or by manual input the number of drill rods 38. The input device (not illustrated) may be user input electronic device for enabling a user to input information to and receive information back from the controller 22. Examples of the input device include a touch screen and number pad with a display. In embodiments, the input device may include an input for a user entering the depth of the drill bit and/or the number of drill rods 38, which may be used by the controller to determine the depth of the drill bit.

The air compressor system 100 is being used by a drilling rig application. The drilling rig application drills a drill hole 40 in the ground to produce holes for blasting or to explore for minerals and/or petroleum. The drilling rig application may include a drill rod 38, a drill hole 40, a drill bit 42, and flushing air 44.

The drill rod 38 may be a hollow, thick-walled, steel tubing to facilitate the drilling of a drill hole 40. The drill rod 38 may be approximately 30 feet long and be connectable to other drill rods 38 to form a drill string. The drill bit 42 may be constructed of a hard material such as diamond or carbide for drilling in the earth and may include a hollow portion for conveying the flushing air 44. The flushing air 44 may be compressed air from the compressor system 100 that is used to flush the drill hole 40 from the earth crushed by the drill bit 42. The drill hole 40 is the hole formed by the operation of drilling by turning the drill bit 42 and drill rod 38. A drilling rig configured to turn the drill rod 38 and drill bit 42 and add new drill rods 38 to a drill string is not illustrated.

In operation, the controller 22 controls the operation of the air compressor system 100. The following is a description of the air compressor system 100 delivering working air here depicted as flushing air 44 when the adjustable air inlet 12 is at least partially open and when the working air outlet valve 36 is open.

Air flows through the air filter 10 and is filtered by the air filter 10. The air flows through the adjustable air inlet valve 12, which is configured to control the amount of air that can flow through the adjustable air inlet valve 12. The controller 22 controls how open the adjustable air inlet valve 12 is by providing electricity to the solenoid 14A. By adjusting the adjustable air inlet valve 12 the controller 22 can control the volume of compressed air delivered by the air compressor 20. This may be called throttling the air compressor system 100 by controlling the opening of the adjustable air inlet valve 12. As discussed above it may be impractical to control the volume of compressed air delivered by the air compressor 20 by controlling the engine 18 that drives the air compressor 20 or by controlling 20 the connection between the air compressor 20 and the engine 18 (gears for example.)

The air that flows through the adjustable air inlet valve 12 flows into the air inlet 19 of the air compressor 20 and is compressed by the air compressor 20, which delivers a volume of compressed air to the air outlet 21 of the air compressor 20. The air compressor 20 is driven by the engine 18. The controller 22 may receive an indication how fast the motor 18 is going, but, in embodiments, the controller 22 cannot change the speed of the engine 18 (this may be because the air compressor system 100 may be only one application that is being driven by the engine.) In embodiments, the controller 22 may be able to change the speed of the engine 18. For example, the controller 22 may be able to switch the engine 18 from a low idle RPM state to a high RPM state, and/or through a range of RPM states, and/or from an on state to an off state.

The compressed air then flows through the main air discharge passage 50 and through the non-return valve 28. The non-return valve 28 permits oil and air to flow through it in only the direction from the air outlet of the compressor 21 toward the air inlet of the receiver 33. Because the non-return valve 28 permits oil and air to flow only in one direction, the pressure may be different on the air compressor 20 side of the non-return valve 28 than the air pressure on the receiver 34 side of the non-return valve 28.

The compressed air then flows into the air inlet 33 of the receiver 34 into the receiver 34. The receiver 34 may provide multiple functions for the air compressor system 100. First, it may provide for oil recirculation which will be discussed below. Second, it may provide a means of storing compressed air so that the air compressor 20 does not have to deliver compressed air all the time when only relatively small amounts of compressed air are required for accessory use through the accessory compressed air supply line 48 or when only relatively small amounts of compressed air are required for oil recirculation.

The compressed air then flows out of the air outlet of the receiver 35 and through the working air outlet valve 36. The working air outlet valve 36 may be operable by a user of the air compressor system 100 to operate either in an open or closed state. In alternative embodiments, the working air outlet valve 36 may be controlled by the controller 22. After flowing through the working air outlet valve 36, the compressed air then flows down through the drill rod 38 and through and out the drill bit 42 as flushing air 44. The flushing air 44 flows up the drill hole 40 and aids in removing the parts of the earth that were broken up by the drill bit 42.

Thus the air compressor system 100 is configured to deliver working air as flushing air 44.

The adjustable air inlet valve 12 may be called an output control of the air compressor system 100 because it controls the volume of air produced by the air compressor system 100. In embodiments, the output control of the air compressor system may be adjusted by increasing or decreasing the RPMs of the engine. In embodiments, the output control of the air compressor may be adjusted by increasing or decreasing a clutch control between the engine 18 and the air compressor 20. For example, a magnetic clutch may be positioned between the engine 18 and the air compressor 20 and the clutch adjusted by varying the strength of a magnetic field or by varying a gap between a clutch portion associated with the air compressor 20 and a clutch portion associated with the engine 18.

Figure 2:
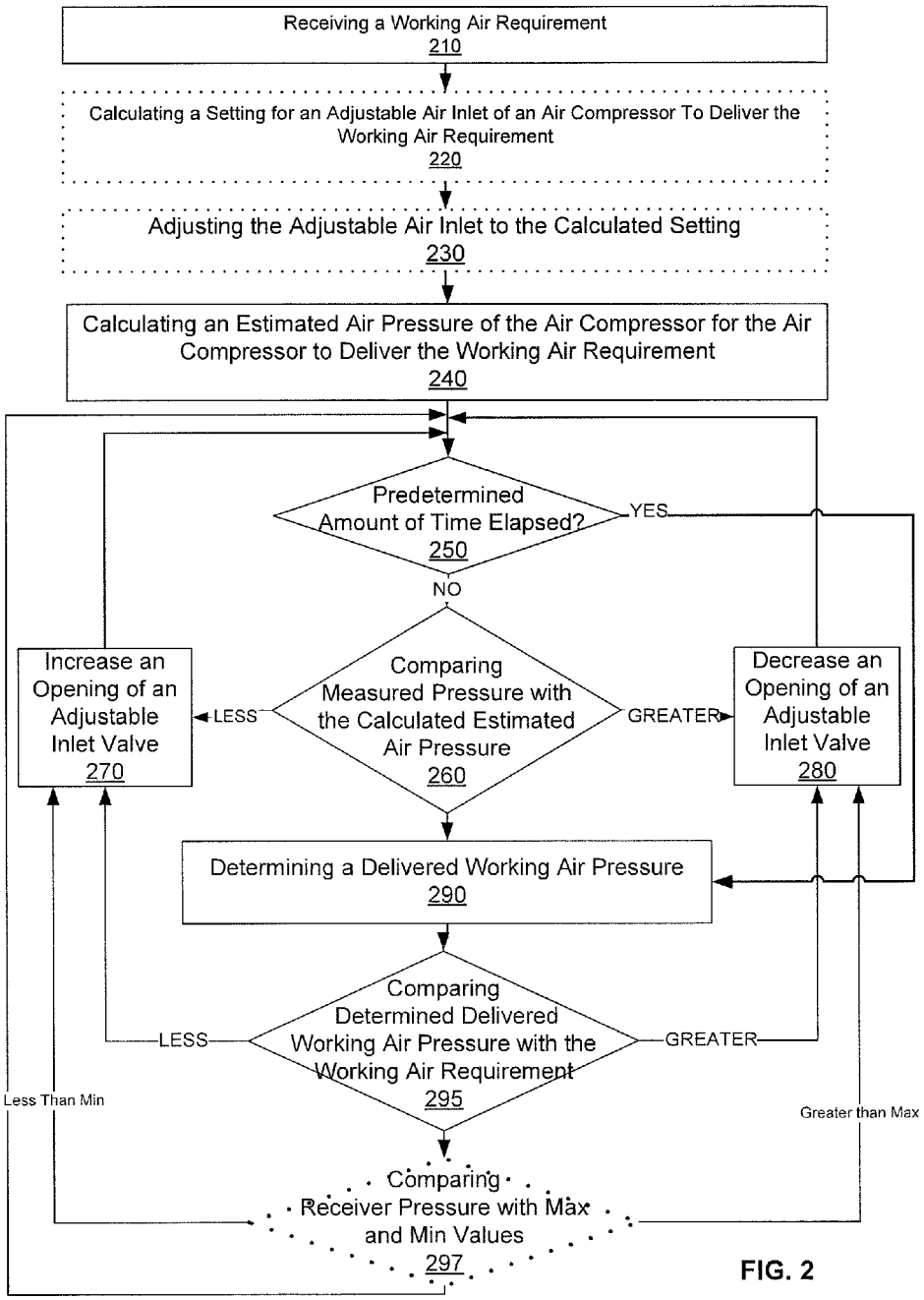
FIG. 2 is an illustration of a method of controlling an air compressor system.

FIG. 2 illustrates an example of a method of controlling an air compressor system. Example equations are used below for calculation. Other equations are possible and the method is not limited to the specific equations used in the example below. The method begins with receiving a working air requirement 210. A working air requirement may be received from the input device (not illustrated) of FIG. 1. As an example, the user of the air compressor system 100 with an application of a drilling rig may enter a drill pipe diameter, a drill bit diameter, and a desired up hole velocity (UHV) for the flushing air. The working air requirement can then be calculated as:

$$\text{Working Air Requirement}=D\times(B/1000^2-A/1000^2)/183.4. \qquad \text{Equation (1):}$$

Where A=drill pipe diameter, B=drill bit diameter, and D=desired UHV.

In embodiments, the working air requirement may be a desired working air pressure delivered to the working air outlet valve 36. In embodiments, the controller 22 may receive a desired working air pressure and an indication of the diameter of an accessory attached to the working air outlet valve 36. In embodiments, the controller 22 may receive a desired working air volume.

Optionally, the method may continue with calculating a setting for an adjustable air inlet of an air compressor to deliver the working air requirement 220. The setting for the adjustable air inlet (see element 12 of FIG. 1) of an air compressor is as follows. Calculate a maximum UHV that the air compressor system could deliver based on the user inputs as:

$$\text{Maximum } UHV=C\times 183.4/(B/1000^2-A/1000^2). \qquad \text{Equation (2):}$$

Where A=drill pipe diameter, B=drill bit diameter, and C=the maximum amount the air compressor system could deliver if the adjustable air inlet were opened completely.

From the above the percentage of the Maximum amount the air compressor system can be calculated as follows:

$$\text{Percentage of the Maximum}=\text{Working Air Requirement}/\text{Maximum } UHV. \qquad \text{Equation (3):}$$

From the Percentage of the Maximum the controller 22 can calculate a setting for the adjustable inlet valve so that a Percentage of the Maximum air flows into the adjustable inlet valve. For example, the controller 22 can calculate the opening angle of a butterfly valve based on the extension of a linear actuator. See FIG. 5B for an example where:

$$\text{Angle}=ACOS(X^2+Y^2-(Y+Z)^2)/2XY. \qquad \text{Equation (4):}$$

Where X=bell crank length Y=actuator retracted length Z=actuator extension. From Equation (4), the controller 22 can set the actuator extension for a desired angle of the butterfly valve so that a Percentage of the Maximum air flows into the air compressor.

Figure 5A:
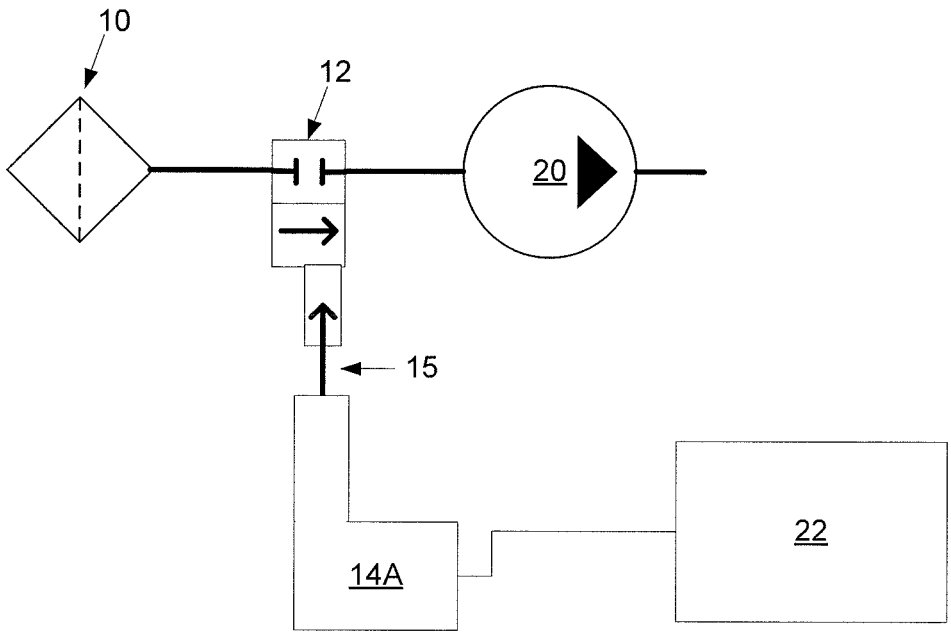
FIG. 5A illustrates an example of the adjustable air inlet valve.

Therefore, a setting for the adjustable inlet valve may be calculated as the example above illustrates for the embodiment of the adjustable inlet valve of FIG. 5. In embodiments, the controller may calculate a setting for a different output control of the air compressor. For example, a number of RPMs for the engine or for a setting for a clutch.

The method optionally continues with adjusting the adjustable air inlet to the calculated setting 230. The controller for the embodiment of the adjustable air inlet valve of FIG. 5 may set the linear actuator extension to a value so that the butterfly valve permits a Percentage of the Maximum air to flow into the air compressor. Thus, the air compressor system can make an initial setting of the adjustable inlet valve based on receiving a working air requirement. In embodiments, the controller may adjust a different output control of the air compressor. For example, the controller may set an RPM of the engine and/or the controller may set a clutch control.

In embodiments, the controller may adjust the adjustable air inlet to a value less than the calculated setting. For example, the linear actuator extension may be set to a value of fifty (50) percent of the calculated setting. This may have the advantage that when the drill hole is first started, the volume of air is less so that the rush of air from the drill bit does not blow the top of the hole away. The reduced calculated setting may be maintained only for a brief period of time or a brief distance of drilling. For example, only the first one (1) or two (2) meters of the drill hole. The distance of drilling may be detected by the depth sensor and/or by user input. In embodiments, the controller may set a different output control of the air compressor.

The method continues with calculating an estimated air pressure of the air compressor for the air compressor to deliver the working air requirement 240. The following example illustrates how the estimated air pressure of the air compressor may be calculated when the air pressure of the air compressor is measured at the air inlet (19 of FIG. 1) of the air compressor (20 of FIG. 1). Percentage of the Maximum may be calculated as in Equation (3) above. From the Percentage of the Maximum the estimated air pressure of the compressor can be calculated as follows:

$$\text{Estimated Air Pressure in Hg}=(-0.29\times(\text{Percentage of the Maximum}\times 100))+30. \qquad \text{Equation (5):}$$

From the Estimated Air Pressure in Hg a Estimated Pressure in milli-Amps (mA) from the pressure sensor (16A of FIG. 1) can be calculated as follows:

$$\text{Estimated Pressure in mA}=(0.533\times\text{Estimated Air Pressure in Hg})+4. \qquad \text{Equation (6):}$$

The Calculated Estimated Air Pressure of the Air Compressor in this example is the Estimated Pressure in Hg. In embodiments, the calculated estimated air pressure may be predetermined and stored so that the controller looks up an estimated air pressure value based on the received working air requirement. In embodiments, the calculated estimated air pressure may be adjusted to compensate for air leaks in the system and for other uses of the compressed air.

Therefore, as the above example illustrates an Estimated Air Pressure in Hg can be calculated and the pressure can be measured and transmitted to the controller.

The method optionally continues with has a predetermined amount of time elapsed 250. If the predetermined amount of time has elapsed then the method skips over the step of adjusting the adjustable inlet valve based on the calculated estimated air pressure. The predetermined amount of time may be a time period such as 10 seconds to several minutes. In embodiments, the predetermined amount of time may be long enough that the step of adjusting the adjustable inlet valve based on the calculated estimated air pressure is never skipped. If the predetermined amount of time has not elapsed then the method continues to comparing a measured pressure of the air compressor with the calculated estimated air pressure 260. The measured pressure of the air compressor may be in milli-amps when received by the controller and as demonstrated above the calculated estimated air pressure may be converted to a milli-amp reading.

If the measured pressure of the air compressor is less than the calculated estimated air pressure, then method continues with step 270. If the measured pressure of the air compressor is greater than the calculated estimated air pressure, then the method continues with step 280. In embodiments, the measured pressure of the air compressor must be less than the calculated estimated air pressure by a predetermined lesser amount for the method to continue with step 270. In embodiments, the measured pressure of the air compressor must be greater than the calculated estimated air pressure by a predetermined greater amount for the method to continue with step 280. By including a predetermined greater amount and a predetermined lesser amount the air compressor system may be less likely to fluctuate rapidly. For example, the predetermined greater amount could be 20% above the calculated estimated air pressure and the predetermined lesser amount could be 20% below the calculated estimated air pressure so that the air compressor system would be controlled with a band of plus or minus 20% of the calculated estimated air pressure. Adjusting the adjustable inlet valve based on a measured pressure of the air compressor has the advantage that measured pressure may be a more accurate indication of the actual volume of air delivered by the air compressor than setting an opening amount of the adjustable inlet valve. This may be for several reasons. The reasons include that temperature differences may make it difficult to set the adjustable inlet valve to a particular opening value and that the adjustable inlet valve may be difficult to calibrate.

In step 270 the opening of the adjustable inlet valve is increased so that the air compressor system delivers more compressed air. The method then returns to step 250. In step 280 the opening of the adjustable inlet valve is decreased so that the air compressor system delivers less compressed air.

Step 260 continues to step 290 if the measured pressure of the air compressor is neither less than nor greater than the calculated estimated air pressure (with possibly a predetermined lesser amount and a predetermined greater amount). Step 290 is determining a delivered working air pressure. In embodiments, the determined delivered working air pressure may be determined by calculating a running average of a delivered working air pressure. An example of the delivered working air pressure is illustrated in FIG. 1 as the flushing air pressure sensor 16D. The delivered working air pressure may be measured in different places. The running average may be calculated over a predetermined period of time such as ten (10) seconds by repeatedly sampling the measured pressure of the delivered working air pressure regularly and then dividing by the number of samples after the predetermined period of time. Many other predetermined periods of time are possible such as two (2) seconds and ten (10) minutes. Additionally, a running average could be calculated in many different ways. For example, three (3) readings of the delivered working air pressure could be taken and the middle reading of the three (3) reading could be used to compare with the working air requirement. As another example, the delivered working air pressure could be determined by monitoring the delivered working air pressure and if the working air pressure falls below a certain predetermined amount (for example, five (5) percent) below the working air requirement, then the value for the delivered working air pressure that is below five (5) percent may be used to determine whether or not to adjust the air compressor. In embodiments, readings of the delivered working air pressure that are above a certain predetermined high value or below a predetermined low value may be ignored. In embodiments, readings of the delivered working air pressure are evaluated by the controller over a period of time and used to determine whether or not to adjust the delivered working air pressure.

After step 290, the method continues with comparing the determined delivered working air pressure with the working air requirement 295. The determined delivered working air pressure may be determined as explained above. In embodiments, the determined delivered working air pressure may be compared with the working air requirement by comparing the calculated running average with the working air requirement 295. The calculated running average may be compared with the Working Air Requirement (from Equation (1) and step 210 above). If the calculated running average is greater than the working air requirement then the method may continue to step 280. If the calculated running average is less than the working air requirement then the method may continue to step 270. In embodiments, if the calculated running average is greater than the working air requirement by a second predetermined greater amount then the method may continue to step 280. The second predetermined greater amount may be a fixed amount or a percentage of the working air requirement. In embodiments, if the calculated running average is less than the working air requirement by a second predetermined lesser amount then the method may continue to step 270. The second predetermined lesser amount may be a fixed amount or a percentage of the working air requirement. All of the predetermined amounts discussed above and below may be adjusted during the method to improve performance of the air compressor system. In embodiments, the controller may use the delivered working air pressure to determine whether or not to adjust the air compressor.

In embodiments, the working air requirement may change according to a depth of a drill bit. For example, the working air requirement may be increased by about 5% per 10 meters. The increased working air requirement may be needed to increase the flushing air to compensate for the greater depth of the drill hole. The depth of the drill bit may be determined from the depth sensor (16E of FIG. 1) or from user input from the input device. Additionally, the controller may re-calculate the calculated estimated air pressure if the working air requirement is changed according to a depth the drill bit.

If the method does not continue to either step 270 or step 280 then the method continues to optional step 297. Step 297 is comparing receiver pressure with maximum (max) and minimum (min) values. If the receiver pressure (for example element 16C of FIG. 1) is greater than a max (max may be 100 pounds per square inch (psi) for a low pressure operation and 550 psi for high power operation) then the method continues to step 280. If the receiver pressure (for example element 16C of FIG. 1) is less than a max (min may be 30 psi for a low pressure operation and 80 psi for high power operation) then the method continues to step 270. Otherwise the method continues back to step 250.

If the optional step 297 is not present then the method continues to step 250 from step 295 if the method does not continue to step 270 or step 280. The method may terminate for multiple reasons. Among the reasons the method may terminate are the controller may receive an indication that the working air is no longer required and/or the controller may receive an indication that the air compressor system is to be shut down. Thus, a method of controlling the air compressor system has been demonstrated.

In embodiments, steps 290 and 295 are optional. In embodiments, steps 260 295, and 297 may be in a different order. In embodiments, the method may not adjust the adjustable inlet valve in steps 280 and 270 until determining whether the adjustable inlet valve needs to be adjusted according to steps 260 and 295 and optionally step 297. The method may prioritize one or more of steps 260, 295 and 297 to determine whether or not to adjust the adjustable inlet valve. Alternatively, or in addition, the method may adjust the adjustable inlet valve based on the outcome of the comparisons in 260, 295, and optionally 297 based on a weight of how much of an adjustment is indicated in each of the comparisons.

In embodiments, step 280 may include comparing a delivered working air pressure to a minimum working air pressure and if the delivered working air pressure is not greater than the minimum working air pressure by a predetermined amount then not decreasing the opening of the adjustable inlet valve. The minimum working air pressure may be a setting for maintaining a minimum amount of flushing air so that the drill bit is not damaged or stuck by the debris not being flushed out of the drill hole. In embodiments, step 280 may include comparing the measured pressure of the air compressor with a minimum pressure for a minimum working air, and if the measured pressure of the air compressor is not greater than the minimum pressure for a minimum working air pressure by a predetermined amount then not decreasing the opening of the adjustable inlet valve. The minimum pressure for a minimum working air pressure may be a determined pressure for the air compressor to deliver the minimum working air pressure.

In embodiments, steps 270 and 280 may include adjusting a different output control of the air compressor. For example, a clutch control may be increased or decreased, and/or an RPM of the engine may be increased or decreased.

Figure 3:
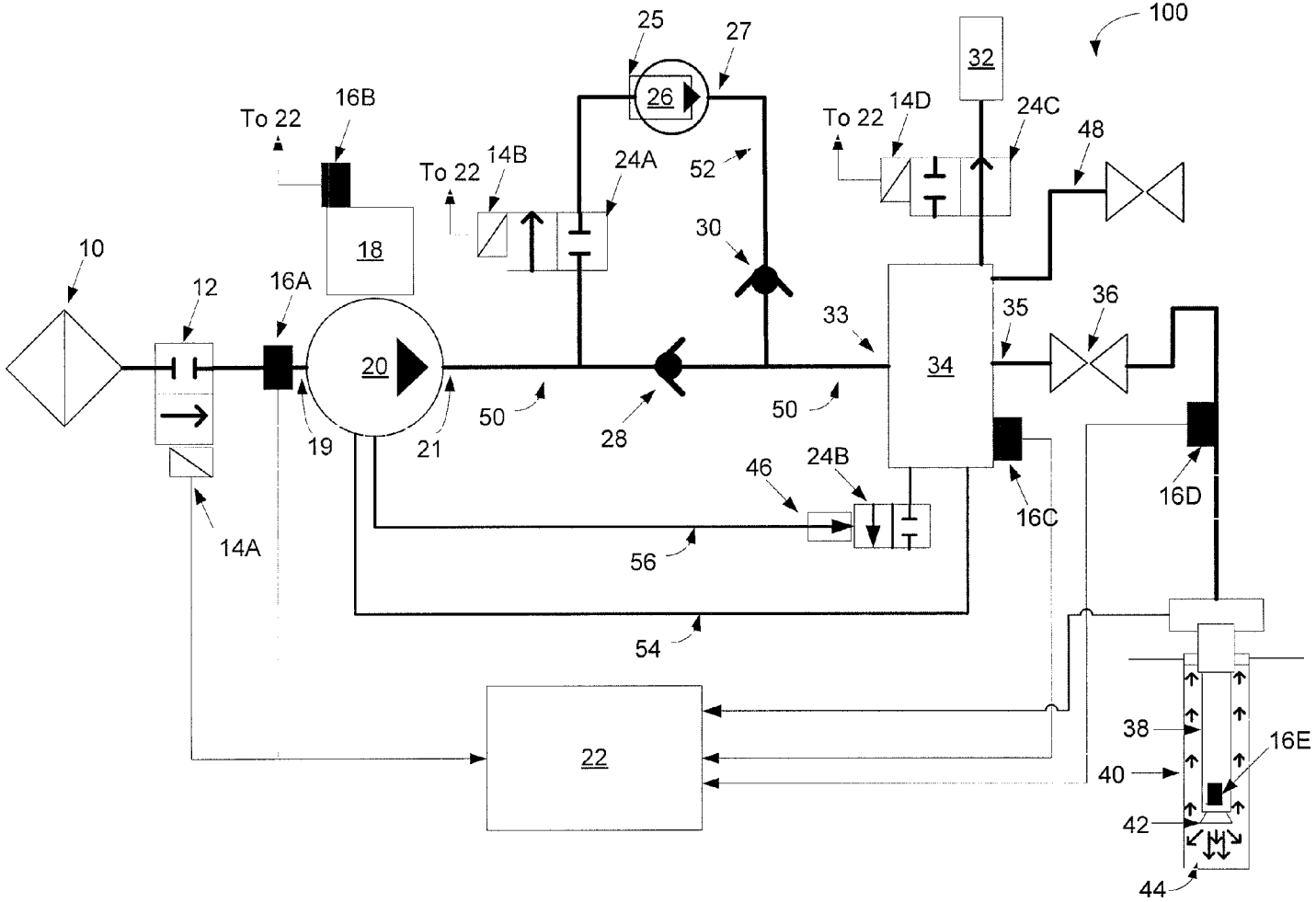
FIG. 3 is the air compressor system illustrated in FIG. 1 with an example of a system to take the air compressor off load and an example of an oil system.

FIG. 3 is the air compressor system illustrated in FIG. 1 with an example of a system to take the air compressor off load and an example of an oil system.

The air compressor system 100 includes a system to take the air compressor 20 off load. The system to take the air compressor 20 off load sucks air from the air outlet of the air compressor 21 when the air compressor system 100 does not need the air compressor 20 to deliver compressed air and the air compressor system 100 has closed the air inlet valve 12.

The system to take the air compressor 20 on and off load includes a evacuation pump 26, an air inlet 25 of the evacuation pump 26, an air outlet 27 of the evacuation pump 26, a solenoid 14C (to control the evacuation pump), a secondary discharge passage 52, another non-return valve 30, an evacuation pump isolation valve 24A, and a solenoid (to control the evacuation pump isolation valve) 14B.

The evacuation pump 26 may be a screw compressor driven by a hydraulic motor (not illustrated). The evacuation pump 26 may be substantially smaller than the air compressor 20. The air inlet 25 of the evacuation pump 26 may be an air inlet 25 of the evacuation pump 26. The air outlet 27 of the evacuation pump 26 may be the air outlet 27 of the evacuation pump 26. The solenoid 14C (to control the evacuation pump) may be an electrical device that produces a magnetic field when current is applied. The solenoid 14C may be in electrical communication with the controller 22. The evacuation pump isolation valve 24A may be an electrically controlled air value having two positions: a spring biased closed position as the default position and an open position that the evacuation pump isolation valve 24A switches to when current is applied to the solenoid 14B. The solenoid 14B (to control the evacuation pump isolation valve 24A) may be an electrical device that produces a magnetic field when current is applied. The solenoid 14B may be in electrical communication with the controller 22. The secondary discharge passage 52 may be a pipe constructed out a suitable material for conveying compressed air and oil. Another non-return valve 30 may be a valve which allows air and oil to flow through it in only one direction from the evacuation pump 26 to the primary discharge passage 50.

The air compressor system 100 includes an oil system to provide oil to the air compressor 20. The oil system provides oil for lubricating the air compressor 20. The oil system includes a first oil line 54, a second oil line 56, an oil stop valve 24B, and an air pressure actuator 46. The first oil line 54 may be a line suitable for suitable for transporting oil from the receiver 34 back to the air compressor 20. The second oil line 56 may be a line suitable for transporting oil from the receiver 34 back to the air compressor 20. The oil stop valve 24B may be a controlled value having two positions: a closed position as a default and an open position that the oil stop valve 24B switches to when pressure is applied to the pressure actuator 46. The oil stop valve 24B may have a spring that keeps the oil stop valve 24B in the closed position unless the air pressure actuator 46 pushes on the oil stop valve 24B. The air pressure actuator 46 may be an actuator in communication with the air pressure of the air outlet 21 of the compressor 20 and the oil stop valve 24B. When the air pressure at the air outlet 21 of the air compressor 20 rises past a predetermined shutoff oil air pressure the air pressure actuator 46 opens the oil stop valve 24B and when the air pressure at the outlet 21 of the air compressor 20 falls below a predetermined shutoff oil air pressure the air pressure actuator 46 no longer opens the oil stop valve 24B, so the oil stop valve 24B closes (in an embodiment a spring biases the valve closed). The solenoid (to control the blow-down valve 24C) may be an electrical device that produces a magnetic field when current is applied.

In operation, the system to take the air compressor 20 on and off load works as follows. The controller 22 determines that the air compressor system 100 does not need the air compressor 20 to generate additional compressed air. The controller 22 then closes the adjustable inlet valve 12, and opens the evacuation pump isolation valve 24A, and turns on the evacuation pump 25. In embodiments, the evacuation pump 25 may already be on. Since the adjustable inlet valve 12 is closed, the air compressor 20 no longer has a source of air to compress. Much of the air that is left in the air compressor 20 is sucked out by the evacuation pump 25 that sucks the air out of the air compressor 20 via the now open evacuation pump isolation valve 24A and conveys the air through the another non-return valve 30. The compressed air in the receiver 34 is blocked from returning to the air compressor 20 by the non-return valve 28 and another non-return valve 30.

When the controller 22 determines that additionally compressed air needs to be generated by the compressor 20, the controller 22 opens at least partially the adjustable inlet valve 12, closes the evacuation pump isolation valve 24A, and may turn off the evacuation pump 26. The air compressor 20 then begins to deliver compressed air again that is conveyed through the non-return valve 28. Therefore, the controller 22 is enabled to take the air compressor 20 on and off load.

The advantage of taking the air compressor 20 off load is that the work the engine 18 performs to drive the air compressor 20 is lessened since the air compressor 20 is not compressing air. The engine 18 continues to drive the air compressor 20 and may continue to drive the air compressor 20 at the same number of revolutions per minute (for a screw air compressor), but since the air compressor 20 is not compressing air the load on the engine 18 is lessened. An explanation was given above for why the engine 18 is not simply slowed down when the air compressor system 100 does not need the air compressor 20 to generate compressed air. When the load on the engine 18 is lessened the engine 18 requires less fuel or electricity to drive the engine 18 and the engine 18 generates less heat.

In operation, an oil system may be used to lubricate the air compressor 20. When the air compressor 20 is on load, the following is a path the oil may follow to lubricate the air compressor 20. The oil may be used to lubricate the air compressor 20. The oil may then flow from the air compressor 20 through the main air discharge passage 50 through the non-return valve 28, and into the receiver 34. In embodiments, the receiver 34 maintains a minimum pressure for conveying the oil back to the air compressor 20. The oil may then flow from the receiver through a first oil line 54 and through an oil stop valve 24B and through a second oil line 56 back to the air compressor 20. Since the air compressor 20 is on load the pressure is large enough for the air pressure actuator 46 to open the oil stop valve 24B, so oil can be conveyed from the receiver 34 through the oil stop valve 24B and the second oil line 56. The oil may be cooled and/or filtered prior to returning to the air compressor 20. The cooling and filtering are not illustrated. The pressure necessary to keep the oil stop valve 24B open may be a predetermined oil opening pressure.

When the air compressor 20 is off loaded (described above), the oil may follow the following path. The oil may be used to lubricate the air compressor 20. The oil may then flow from the air compressor 20 through the main air discharge passage 50, and then through the open evacuation pump isolation valve 24A, and then through the evacuation pump 25, and then through the another non-return valve 30, and then to the receiver 34. Since the air compressor 20 is off load the pressure is not large enough for the air pressure actuator 46 to open the oil stop valve 24B, so oil cannot be conveyed from the receiver 34 through the oil stop valve 24B and the second oil line 56. The oil may flow through the second oil line 56 back to the air compressor 20. The oil may be cooled and/or filtered prior to returning to the air compressor 20. The cooling and filtering are not illustrated.

The advantage to closing the second oil line 56 when the air compressor 20 is off loaded is the air compressor 20 does not need to be lubricated as much when the air compressor 20 is off load as compared with on load. The oil to lubricate the air compressor 20 can then be split into the oil that is needed to lubricate the air compressor 20 both when it is on and off load (here as the first oil line 54) and the oil that is needed to cool the air compressor 20 when it is on load (here the second oil line 56.) The advantage to this is that the conveying the oil from the receiver 34 back to the air compressor 20 consumes energy. In embodiments, the receiver 34 provides compressed air to convey the oil. When the amount of oil that is conveyed is lessened then the amount of compressed air drained from the receiver 34 is lessened. Additionally, the evacuation pump 26 does not need to convey as much oil from the air compressor 20 through another non-return valve 30. Moreover, the controller 22 may be able to leave the air compressor 20 off load for a longer period of time since less air is being drained from the receiver 34. Another advantage is that the load on the engine 18 may be lessened since more oil in the air compressor 20 will increase the load of turning the air compressor 20. In embodiments, the first oil line 54 supplies oil for the bearing lube lines, and the second oil line 56 supplies oil for cooling the air compressor 20.

In embodiments, the controller may adjust a different output control of the air compressor. For example, the controller may set an RPM of the engine and/or the controller may set a clutch control in order to control the amount of air compressed by the air compressor. In embodiments, the air compressor 20 does not suck the air out of the air compressor 20 since when the air compressor 20 is controlled by lowering the RPMs of the engine or by adjusting the clutch the air compressor 20 either does not turn or turns at a low rate when compressed air is not being generated. In embodiments, the oil stop valve 24B may be controlled electronically by the controller. In embodiments, the system to take the air compressor 20 on and off load is not included.

Figure 4:
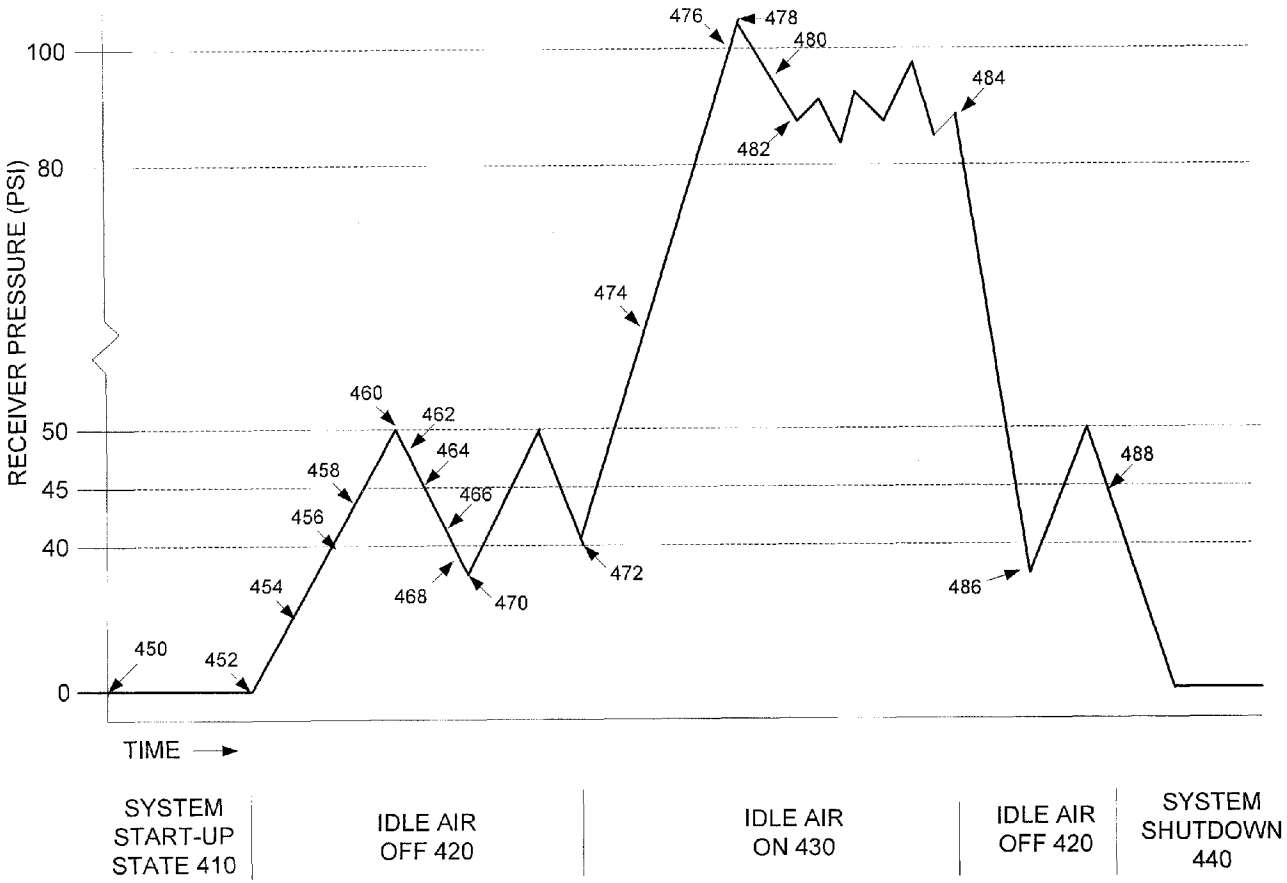
FIG. 4 illustrates an example of the operation of the air compressor system of FIG. 3.

FIG. 4 illustrates an example of the operation of the air compressor system 100 of FIG. 3 with the controller 22 configured as described below. Along the vertical axis is the air pressure of the receiver 34 as measured by the receiver pressure sensor 16C. The horizontal axis has different states the air compressor system 100 may be in. The following explanation should be read with FIGS. 3 & 4. Throughout the explanation that follows the controller 22 may be said to perform an action (for example open or close a valve, or turn on or off a motor), but it should be understood that the action may be unnecessary as the air compressor system 100 may already be in the needed state.

The air compressor system 100 begins in a System Power Up State 410. The controller 22 adjusts an output control of the air compressor 20. For example, the controller 22 may close the adjustable inlet valve 12 (which may be the default state for the adjustable inlet valve 12) so that the air compressor 20 is prevented from compressing more than a small amount of air. In embodiments, the controller 22 may adjust an RPM of the engine 18 and/or adjust a setting of a clutch between the engine 18 and air compressor 20 so that the air compressor 20 is prevented from compressing more than a small amount of air. And the controller 22 opens the blow-down valve 24C. The advantage to closing the adjustable inlet valve 12 and opening the blow-down valve 24C is that it may lessen the load on the engine 18 as it is turning on which may lessen wear and tear on the engine 18. The controller 22 may maintain the air compressor system 100 in the System Power Up State 410 until the motor 18 sufficiently warms up. The air compressor system 100 may enter the System Power Up State 410 by receiving a signal that a key has been turned. As illustrated in FIG. 4, the System Start Up State 410 begins at 450 where the controller 22 may have received a signal that a key had been turned on and/or the controller 22 may have received power and by default entered the System Start Up State 410.

The air compressor system 100 then may go into an Idle Air Off State 410. As illustrated in FIG. 4 the air compressor system 100 enters the Idle Air Off State 410 at 452 upon receiving a signal from the revolutions per minute (RPM's) sensor 16B that the RPM's of the engine 18 have reached a threshold number. In embodiments, the controller 22 may wait a period of time before entering the Idle Air Off State 410 to allow the engine 18 to warm up. In the Idle Air Off State 410 the working air outlet valve 36 is off. The engine 18 may be between a low idle number of RPM's and a high idle number of RPM's. For example, the low idle number of RPM's may be 1200 and the high idle of RPM's may be 1800. In embodiments, the air compressor system 100 has different states for low idle air off and high idle air off.

When in the Idle Air Off State 410, the controller 22 controls the air compressor system 100 as follows. The controller 22 obtains the pressure of the receiver 34 from the receiver pressure sensor 16C. The controller 22 adjusts the adjustable inlet valve 12 to be open when the receiver pressure is less than a predetermined idle receiver pressure (as illustrated in FIG. 4, 40 psi). The controller 22 adjusts the output control of the air compressor when the receiver pressure is greater than a predetermined idle receiver pressure (as illustrated in FIG. 4, 40 psi). For example, the controller may adjust the adjustable inlet valve 12 to be closed. In embodiments, the controller 22 may adjust the adjustable inlet valve 12 to be more open or more closed based on the receiver pressure. In embodiments, the controller 22 may adjust a clutch or the engine 18 to adjust the output control of the air compressor. The controller 22 opens the blow-down valve 24 if the receiver pressure is greater than a predetermined idle receiver pressure too high (as illustrated in FIG. 4, 50 psi). The controller 22 closes the blow-down valve 24 if the receiver pressure is less than a predetermined idle receiver pressure too low (as illustrated in FIG. 4, 45 psi). When the adjustable inlet valve 12 is closed, the controller 22 may take the air compressor 20 off line by opening the evacuation pump isolation valve 24A and turning the evacuation pump 26 on. When the output control of the air compressor is open (for example when the adjustable inlet valve 12 is opened), the controller 22 closes the evacuation pump isolation valve 24A and turns the evacuation pump 26 off.

As discussed above, at 452 of FIG. 4 the air compressor system 100 enters the Idle Air Off State 420. Since the receiver pressure (the varying line in the graph) is below 40 psi the controller 22 opens the adjustable inlet valve 12 and closes the blow-down valve 24C. The receiver pressure builds at 454. At 456 since the receiver pressure has reached 40 psi the controller 22 closes the output control of the air compressor (for example the controller 22 closes the adjustable air inlet valve 12.) The receiver pressure continues to build 458. At 460, the receiver pressure reaches 50 psi, so the controller 22 opens the shut-down valve 24C (which opens up the receiver 24). At 462 the receiver pressure falls due to the shut-down valve 24C being open. At 464 the receiver pressure falls below 45 psi so the controller 22 closes the shut-down valve 24C. At 466 the receiver pressure continues to fall due to the receiver pressure being used for purposes such as conveying the oil from the receiver to the air compressor 20. At 468 the controller 22 opens the output control of the air compressor 20 (for example, the controller 22 opens the adjustable air inlet valve 12) because the receiver pressure has fallen below 40 psi. The controller 22 may take the air compressor 22 off load during the period from 456 through 468. In which case, the controller 22 would put the air compressor 22 back on load at 468 by closing the evacuation pump isolation valve 24A and turning the evacuation pump 26 off. At 470 the receiver pressure begins to build again from having the adjustable air inlet valve 12 being opened. The air compressor system 100 may continue being controlled by the Idle Air Off state until the working air outlet valve 36 is turned on.

The air compressor system 100 may enter an Idle Air On State 430 when the working air outlet valve 36 is turned on (FIG. 4, 472). When in the Idle Air On State 430, the controller 22 controls the air compressor system 100 as follows. The controller 22 obtains the pressure of the receiver 34 from the receiver pressure sensor 16C. The controller 22 adjusts the adjustable inlet valve 12 to be open when the receiver pressure is less than a predetermined-idle-air-on-receiver-pressure-too-low (as illustrated in FIG. 4, 80 psi). The controller 22 adjusts the output control of the air compressor to be closed (for example the controller 22 adjusts the adjustable inlet valve 12 to be closed) when the receiver pressure is greater than a predetermined-idle-air-on-receiver-pressure-too-high (as illustrated in FIG. 4, 100 psi). In embodiments, the controller 22 may adjust the output control of the air compressor (for example the adjustable inlet valve 12) to be more open or more closed based on the receiver pressure. The controller 22 may use an embodiment of one of the methods described with FIG. 2, 6, 9, or 10 to modulate the output control of the air compressor (for example the adjustable inlet valve) when the receiver pressure is between predetermined-idle-air-on-receiver-pressure-too-low (as illustrated in FIG. 4, 80 psi) and predetermined-idle-air-on-receiver-pressure-too-high (as illustrated in FIG. 4, 100 psi). By using an embodiment of the method described with FIG. 2, 6, 9, or 10 the air compressor system 100 may generate less compressed air that is not used as working air (flushing air 44 in FIG. 1).

As described above, the air compressor system 100 enters the Idle Air On State 430 when the working air outlet valve 36 is turned on. In embodiments, the controller 22 may receive a working air requirement as described with FIG. 2. At 472 the controller opens the adjustable air inlet valve 12. (The blow-down valve 24C remains closed and the evacuation pump isolation valve 24A is closed or remains closed.) At 474 the receiver pressure rises past the 100 psi, so the controller 22 closes the output control of the air compressor (for example the adjustable air inlet valve 12.) In embodiments, the controller 22 may only lessen the opening of the output control of the air compressor (for example the adjustable air inlet valve 12.) In embodiments, the controller 22 may adjust the output control of the air compressor (for example the adjustable air inlet valve 12) at 472 according to step 230 of FIG. 2, or from step 260 and/or step 295 of FIG. 2 and/or step 930 of FIG. 9, or from step 960 and/or step 995 of FIG. 9.

At 478 the receiver pressure begins to fall from the output control of the air compressor being closed (for example the adjustable air inlet valve 12 being closed.) At 480 the receiver pressure falls below 100 psi and the controller 22 may begin to adjust the adjustable air inlet valve 12 based on an embodiment of the method described with FIG. 2. For example, between 482 and 484 the output control of the air compressor (for example the adjustable air inlet valve 12) may be adjusted by step 260 and/or step 295 of FIG. 2 and/or step 960 or step 995 of FIG. 9. For example, the adjustable air inlet valve 12 may be adjusted based on comparing a measured pressure (16A of FIG. 3) of the air compressor with the calculated estimated air pressure (which may be calculated using the working air requirement). Alternatively and/or in addition, the adjustable air inlet valve 12 may be adjusted based on comparing the calculated running average (calculated with data from 16D of FIG. 3) with the working air requirement.

At 484 the working air outlet valve 36 is turned off. The air compressor system 100 is not shut down so the system returns to the Idle Air Off State 420. The controller 22 may be configured to transition between the Idle Air On State 430 to the Idle Air Off State 420 as follows. The controller 22 opens the shut-down valve 24C until the receiver pressure falls below 45 psi (a predetermined idle receiver pressure too low). The controller 22 also closes the output control of the air compressor (for example the adjustable air inlet valve 12.) The air compressor system 100 then enters the Idle Air Off State 420 after the pressure in the receive 24 falls below a predetermined pressure. Between 486 and 488 the air compressor system 100 is controlled according to the Idle Air Off State 420 as described above.

At 488 a system shut down signal is received. The air compressor system 100 enters a Shut Down State 440. The controller 22 closes the adjustable air inlet valve 12. The controller 22 opens the shut-down valve 24C. In embodiments, the controller 22 shuts the evacuation pump isolation valve 24A.

The air compressor system 100 is then off.

FIG. 5 illustrates an example of the adjustable air inlet valve 12 as described with FIG. 2. The adjustable air inlet valve is an embodiment of the output control of the air compressor. FIG. 5 includes an air filter 10, an inlet butterfly valve 12, a linear actuator 14A, which is controlled by a controller 22, and an air compressor 22. The air flows through the filter, through the inlet butterfly valve 12 (when it is open), and into the air compressor 22. The inlet butterfly valve 12 is in a default position of closed. A spring (not illustrated) may hold the inlet butterfly valve 12 closed. The linear actuator 14A may be connected to the inlet butterfly valve 12 and the controller 22. The linear actuator 14A may respond to current from the controller 22 by extending the linear extender 15. The linear extender 15 pushes on the inlet butterfly valve 12 which moves the inlet butterfly valve 12 to an open position. The inlet butterfly valve 12 may be adjustable so that the size of the opening of the inlet butterfly valve 12 is proportional to the amount the linear extender 15 pushes on the inlet butterfly valve 12. The controller 22 can then open the inlet butterfly valve 12 an amount based on the current to the linear actuator 14A.

Figure 5B:
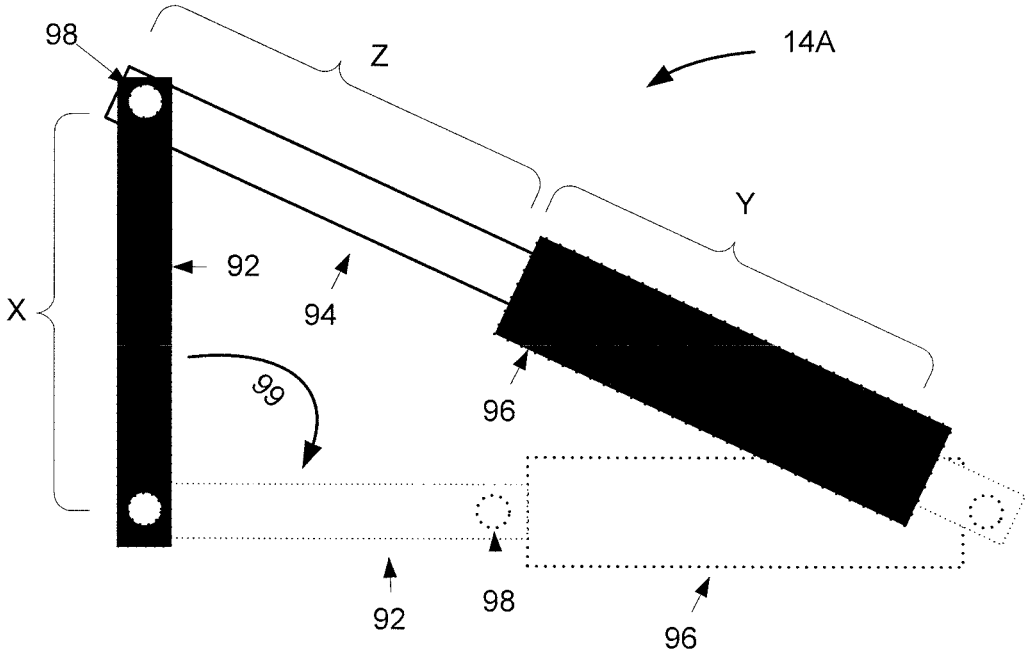
FIG. 5B illustrates an example of the linear actuator pivotally attached to a bell crank.

FIG. 5B illustrates an example of the linear actuator pivotally attached to a bell crank. The linear actuator 14A moves the bell crank between a first position (top part of figure) where the butterfly valve 12 is closed and the linear actuator extender 94 is extended; and, a second position (bottom part of figure) where the butterfly valve 12 is open and the linear actuator extender 94 is not extended. Arrow 99 indicates the motion of the linear actuator 14A between the first position to the second position as the linear actuator extender 94 is withdrawn back into the linear actuator body 96. The linear actuator 14A includes a linear actuator body 96 and an actuator extender 94. The linear actuator body has a length Y. The actuator extender 94 has a length Z when fully extended. As illustrated the linear actuator extender 94 is pivotally connected with a rivet 98 to a bell crank 92 with length X. The angle that the butterfly valve is open may be calculated from the following equation given the geometry illustrated in FIG. 5B. Angle=ACOS(X^2+Y^2−(Y+Z)^2)/2XY.

Figure 6:
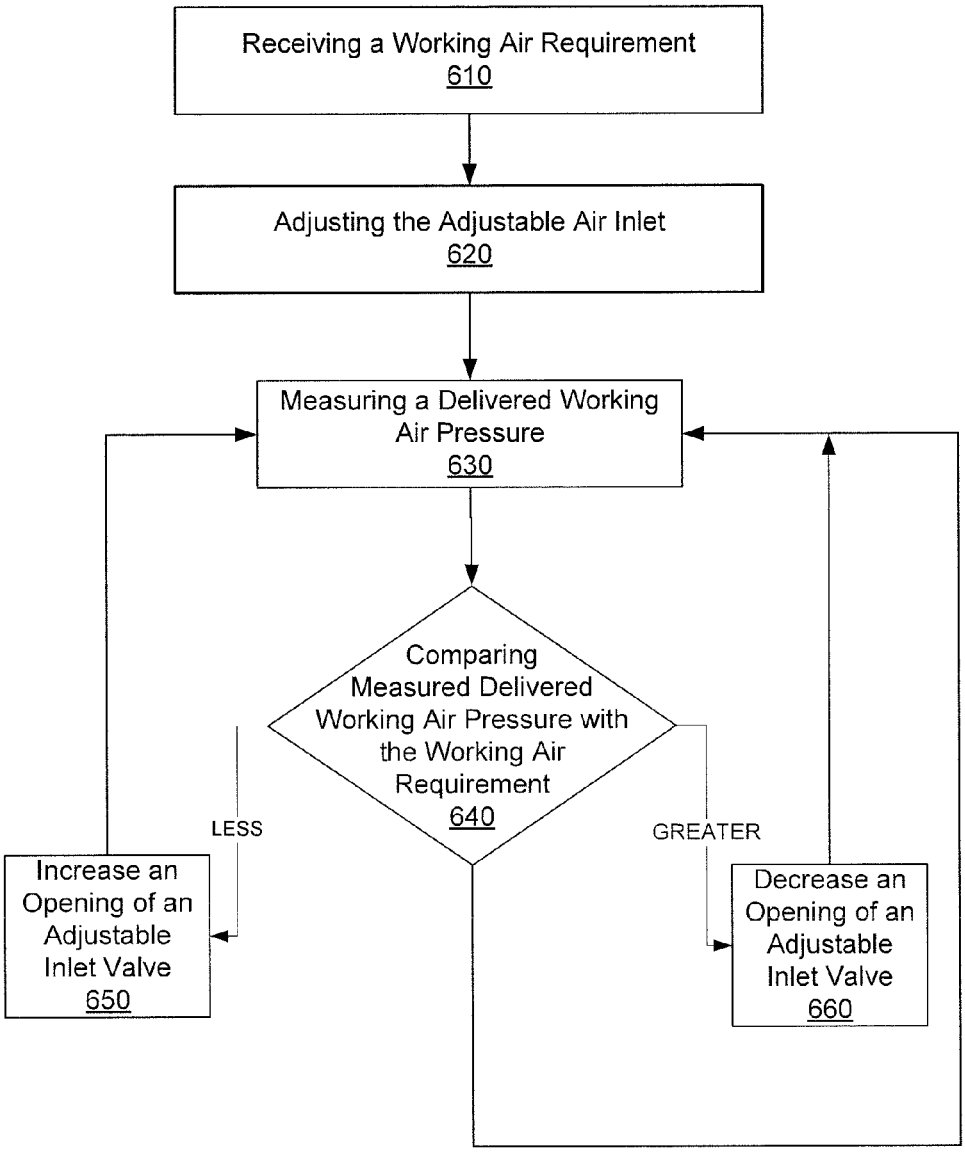
FIG. 6 illustrates an example of a method of controlling an air compressor system.

FIG. 6 illustrates an example of a method of controlling an air compressor system. The method begins with receiving a working air requirement 610. A working air requirement may be received from the input device (not illustrated) of FIG. 1. As an example, the user of the air compressor system 100 with an application of a drilling rig may enter a drill pipe diameter, a drill bit diameter, and a desired up hole velocity (UHV) for the flushing air. The working air requirement can then be calculated as described above.

In embodiments, the working air requirement may be a desired working air pressure delivered to the working air outlet valve 36. In embodiments, the controller 22 may receive a desired working air pressure and an indication of the diameter of an accessory attached to the working air outlet valve 36. In embodiments, the working air requirement may change according to a depth of a drill bit. For example, the working air requirement may be increased by about five (5) % per ten (10) meters. The increased working air requirement may be needed to increase the flushing air to compensate for the greater depth of the drill hold.

The method continues with adjusting the adjustable air inlet 620. The adjustable air inlet 620 may be adjusted to a predetermined opening for beginning to supply working air.

Optionally, the method may include prior to step 620 calculating a setting for an adjustable air inlet of an air compressor to deliver the working air requirement. The setting for the adjustable air inlet (see element 12 of FIG. 1) of an air compressor may be calculated as described above. As described above, in embodiments, the controller may adjust the adjustable air inlet to a value less than the calculated setting for a brief period of time or a brief distance of drilling.

In embodiments, the controller may calculate a setting for a different output control of the air compressor. For example, a number of RPMs for the engine or for a setting for a clutch.

The method continues with measuring a delivered working air pressure 630. An example of the delivered working air pressure is illustrated in FIG. 1 as the flushing air pressure sensor 16D. The delivered working air pressure may be measured in different places including at or near where the working air is delivered. A running average may be calculated for the delivered working air pressure as discussed above.

The method continues with comparing the measured delivered working air pressure with the working air requirement 640. If the measured delivered working air pressure is greater than the working air requirement then the method may continue to step 660. If the measured delivered working air pressure is less than the working air requirement then the method may continue to step 650. In embodiments, the comparison may be to determine whether the measured delivered working air pressure and the working air requirement are within a predetermined amount to determine whether or not to adjust the adjustable air inlet valve.

In embodiments, step 640 may include comparing the measured delivered working air pressure to a minimum working air pressure and if the measured delivered working air pressure is not greater than the minimum working air pressure by a predetermined amount then not decreasing the opening of the adjustable inlet valve. The minimum working air pressure may be a setting for maintaining a minimum amount of flushing air so that the drill bit is not damaged or stuck by the debris not being flushed out of the drill hole.

If the method does not continue to either step 650 or step 660 then the method may return to 630.

Optionally, the method may include the following steps: calculating an estimated air pressure of the air compressor for the air compressor to deliver the working air requirement, measuring a pressure of the air compressor, and, comparing the measured pressure of the air compressor with the calculated estimated air pressure. These steps and the corresponding steps to adjust the adjustable air inlet valve may be implemented as discussed above.

Optionally, the method may include comparing receiver pressure with maximum (max) and minimum (min) values. This step and the corresponding steps to adjust the adjustable air inlet valve may be implemented as discussed above.

The method may terminate for multiple reasons. Among the reasons the method may terminate are the controller may receive an indication that the working air is no longer required and/or the controller may receive an indication that the air compressor system is to be shut down. In embodiments, the controller may adjust a different output control of the air compressor. For example, the controller may set an RPM of the engine and/or the controller may set a clutch control. Thus, a method of controlling the air compressor system has been demonstrated.

Figure 7A:
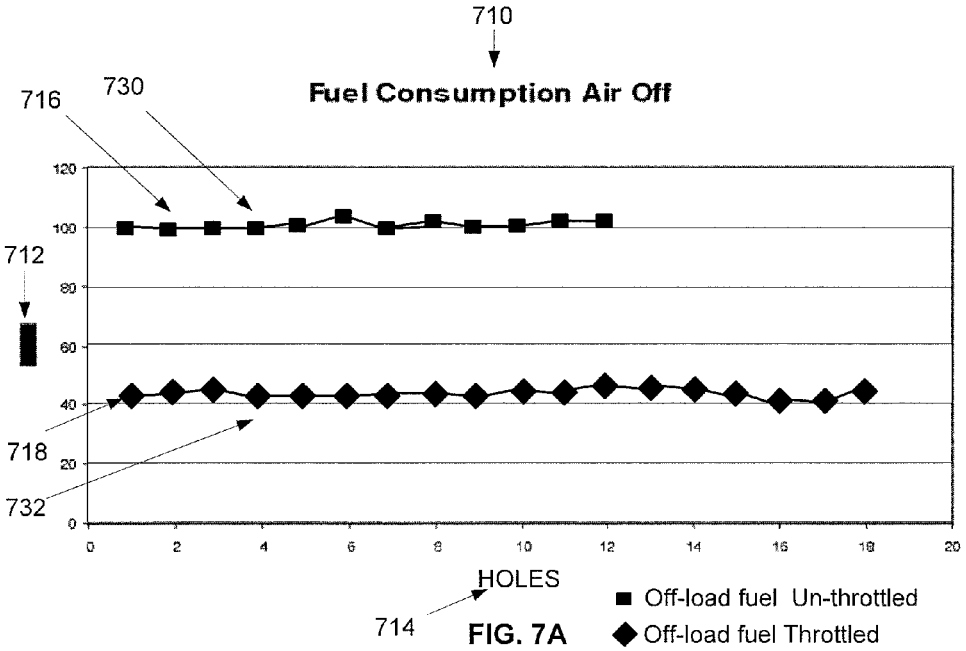
FIGS. 7A and 7B illustrate fuel consumption during actual tests for an air on and an air off state respectively for a conventionally controlled air compressor for supporting a drilling rig vs. an embodiment of the invention as described herein.
Figure 7B:
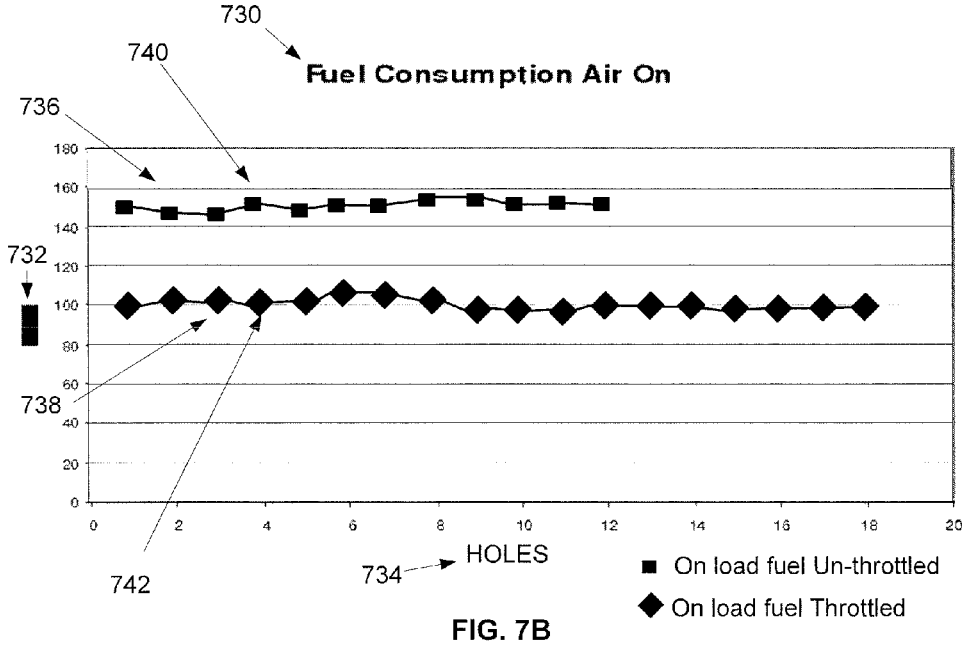

FIGS. 7A and 7B illustrate fuel consumption during actual tests for an air on and an air off state respectively for a conventionally controlled air compressor for supporting a drilling rig vs. an embodiment of the invention as described herein.

The following description of an actual test performed is applicable to FIGS. 7 and 8. A test was performed with an actual drilling rig. During the tests the air compressor system 100 (see FIG. 3) was used for two-hundred-and-sixty-two (262) hours with the air off (see FIG. 4 element 420) and used for three-hundred-and-ten (310) hours with the air on (see FIG. 4 elements 420 and 430). This is a drilling vs. non-drilling ratio of fifty-four (54) percent (%). Based on a drill bit (see FIGS. 1 and 3, element 42) and drill pipe 38 (see FIGS. 1 and 3 for the following discussion) size an optimum up-hold velocity (UHV) of the flushing air 44 was calculated as 8000 ft/min with a required compressor volume of 1000 CRM. A nine-inch (9") drill bit 42 with a seven-point-six-two-five-inch (7.625") drill pipe 38 has approximately five-eighths-of-an-inch (⅝") clearance between the drill pipe 38 and the drill hole 40 for the debris from drilling to travel out the drill hole 40. To compensate for the small area the UHV was increased to ten-thousand (10,000) ft/min.

FIG. 7A illustrates a comparison of an average amount of fuel consumed 712 for each of twenty (20) drill holes 714 for the Air Off 710. Line 716 is for the conventionally controlled air compressor system. Line 718 is for the air compressor system 100 according to an embodiment disclosed herein (FIG. 4, element 420). For example, for drill hole "4", the conventionally controlled air compressor system consumed approximately one-hundred-and-two (102) liters of fuel per hour 720 while the air compressor system 100 according to an embodiment disclosed herein consumed forty-two (42) liters of fuel per hour 722. On average for the twenty holes illustrated in FIG. 7A the air compressor system 100 according to an embodiment disclosed herein consumed approximately fifty-eight-point-five-percent (58.5%) less fuel than the conventionally controlled air compressor system.

FIG. 7B illustrates a comparison of an average amount of fuel consumed 732 for each of twenty (20) drill holes 734 for the Air On 730. Line 736 is for the conventionally controlled air compressor system. Line 738 is for the air compressor system 100 according to an embodiment disclosed herein (FIG. 4, element 430). For example, for drill hole "4", the conventionally controlled air compressor system consumed approximately one-hundred-fifty (150) liters of fuel per hour 740 while the air compressor system 100 according to an embodiment disclosed herein consumed one-hundred-and-one (101) liters of fuel per hour 742. On average for the twenty holes illustrated in FIG. 7B the air compressor system 100 according to an embodiment disclosed herein consumed approximately thirty-three-point-three-percent (33.3%) less fuel than the conventionally controlled air compressor system.

Figure 8A:
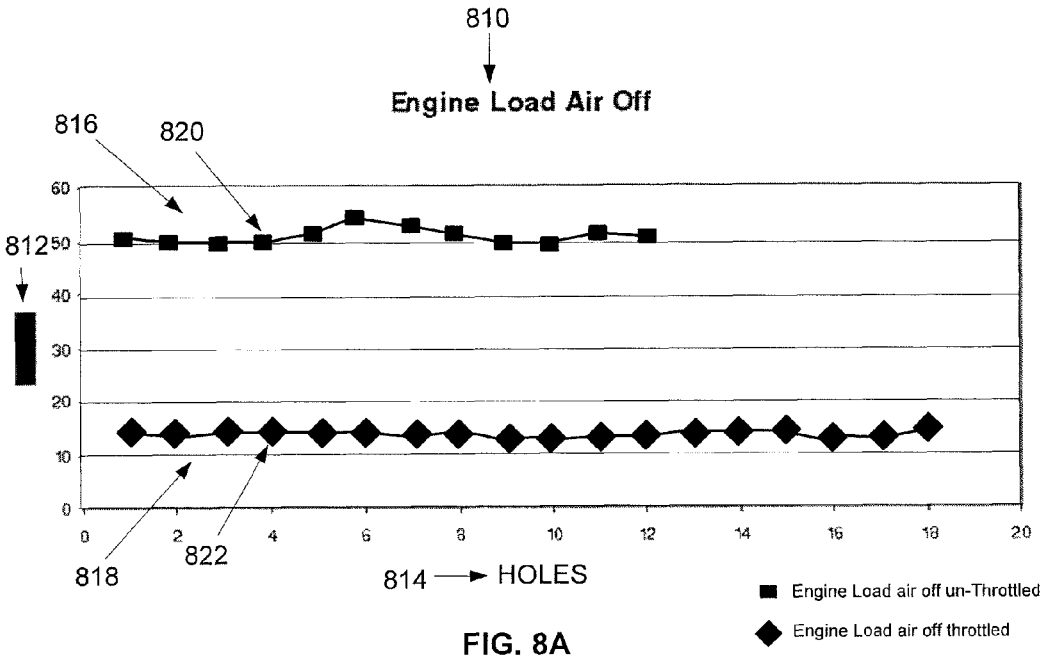
FIGS. 8A and 8B illustrate average engine load during actual tests for an air on and an air off state respectively for a conventionally controlled air compressor for supporting a drilling rig vs. an embodiment of the invention as described herein.
Figure 8B:
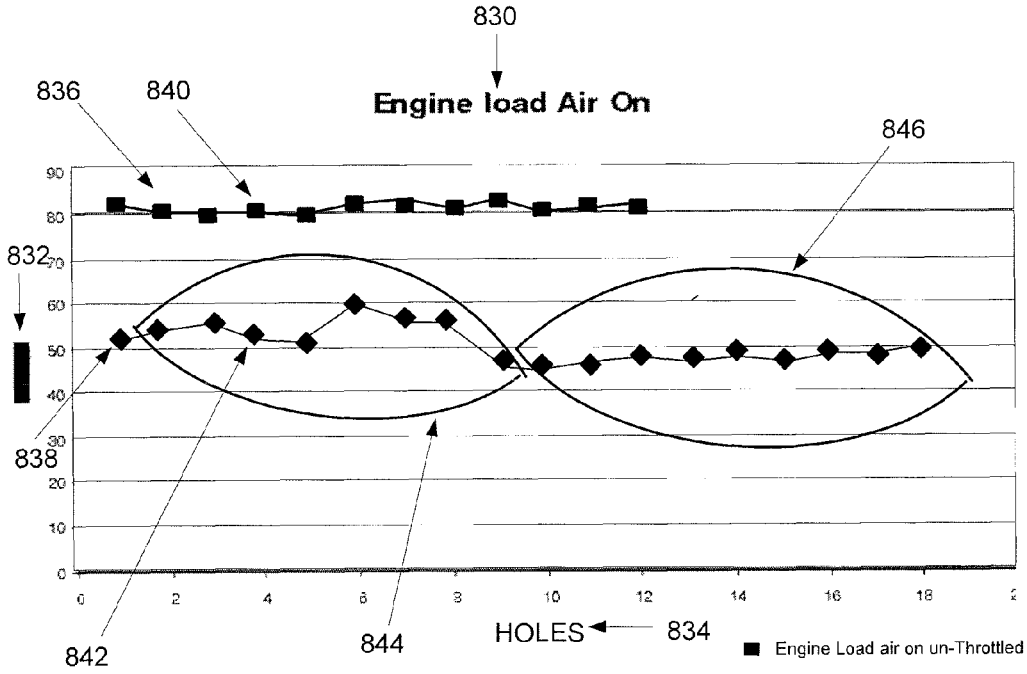

FIGS. 8A and 8B illustrate average engine load during actual tests for an air on and an air off state respectively for a conventionally controlled air compressor for supporting a drilling rig vs. an embodiment of the invention as described herein.

FIG. 8A illustrates a comparison of an average engine load 812 for each of twenty (20) drill holes 814 for the Air Off 810 (see element 420 of FIG. 4). The engine is element 18 in FIGS. 1 and 3. Line 816 is for the conventionally controlled air compressor system. Line 818 is for the air compressor system 100 according to an embodiment disclosed herein (FIG. 4, element 420). For example, for drill hole "4", the conventionally controlled air compressor system had an average engine load of approximately fifty-percent (50%) 820 while the air compressor system 100 according to an embodiment disclosed herein had an average engine load of approximately fourteen-percent (14%) 822. On average for the twenty holes illustrated in FIG. 8A the air compressor system 100 according to an embodiment disclosed herein had an average decrease in engine load of seventy-two-point-nine-percent (72.9%) compared with the conventionally controlled air compressor system.

FIG. 8B illustrates a comparison of an average engine load 832 for each of twenty (20) drill holes 834 for the Air On 830 (see element 430 of FIG. 4). The engine is element 18 in FIGS. 1 and 3. Line 836 is for the conventionally controlled air compressor system. Line 838 is for the air compressor system 100 according to an embodiment disclosed herein (FIG. 4, element 420). For example, for drill hole "4", the conventionally controlled air compressor system had an average engine load of approximately eight-two-percent (82%) 840 while the air compressor system 100 according to an embodiment disclosed herein had an average engine load of approximately fifty-two-percent (52%) 842. On average for the twenty holes illustrated in FIG. 8B the air compressor system 100 according to an embodiment disclosed herein had an average decrease in engine load of thirty-six-point-three-percent (36.3%) compared with the conventionally controlled air compressor system. The drill holes 834 of circle 844 were done with the air compressor system 100 automatically being throttled up and down to cope with ground conditions. The drill holes 834 of circle 846 were done with the air compressor system 100 being throttled to hold at a fixed optimum calculated volume.

The air compressor system 100 according to embodiments of the invention described herein have the following advantages. The fuel used is reduced. The load of the engine is reduced which lessens the wear on the engine and cost of operating the engine. The amount of compressed air that is used as flushing air is reduced which lessens the amount of water that needs to be used to control dust. Lower compressor loads will extend air compressor life. Lower load on the engine will extend the life of the engine. The number of times the drilling rig needs to be serviced is reduced. For the drilling rig used in the trial it is estimated that for six-thousand (6,000) operating hours (approximately one year of full service) the fuel consumption will be reduced by two-hundred-and-sixty-nine-thousand (269,000) liters.

Additionally, an advantage of controlling the air compressor by measuring a vacuum of the air compressor is that there is no latency in the system that is inherent when a pressure measurement is taken downstream from the air compressor.

Figure 9:
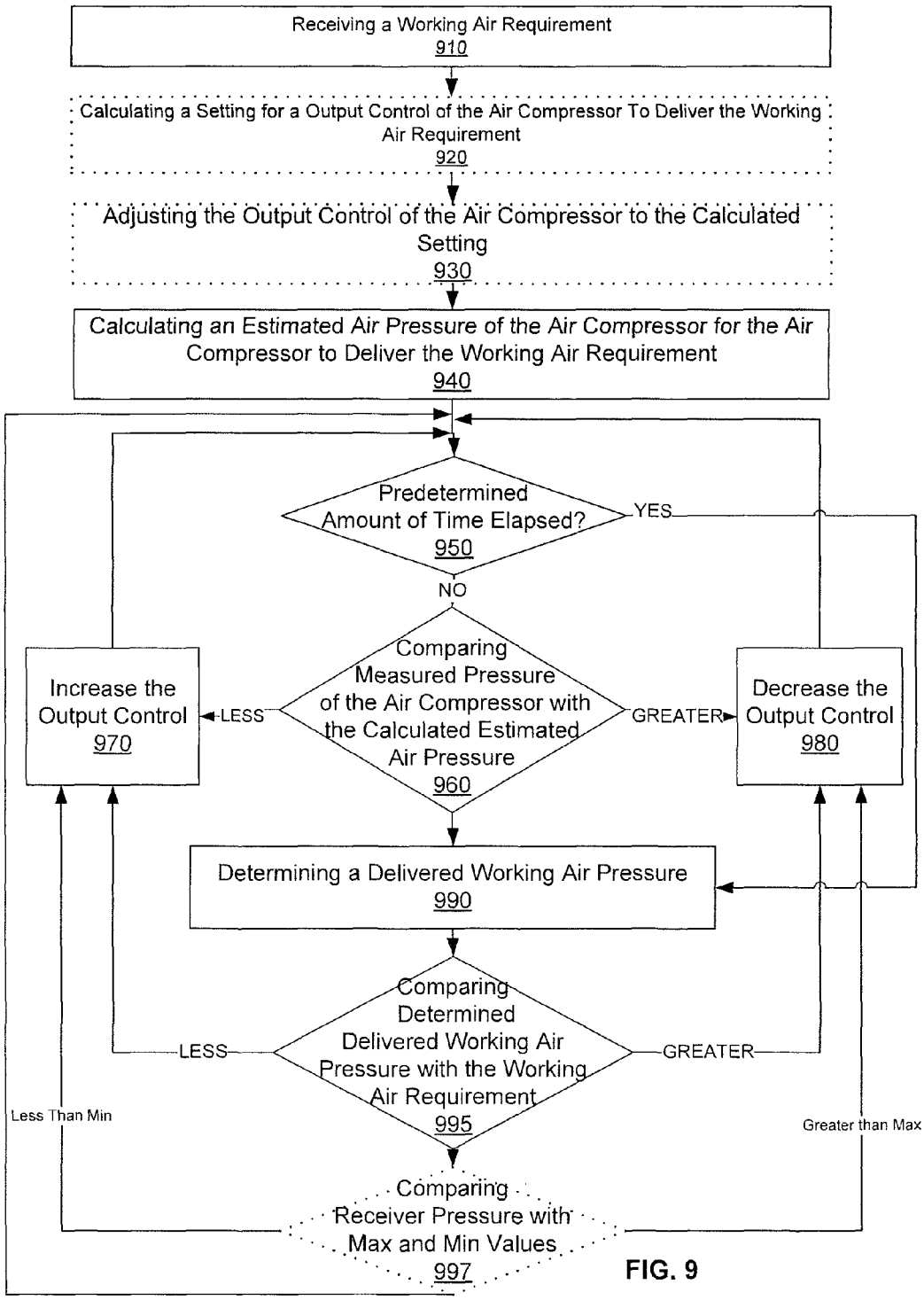
FIG. 9 is an illustration of a method of controlling an air compressor system.

FIG. 9 illustrates an example of a method of controlling an air compressor system. Example equations are used below for calculation. Other equations are possible and the method is not limited to the specific equations used in the example below. The method begins with receiving a working air requirement 910. A working air requirement may be received from the input device (not illustrated) of FIG. 1. As an example, the user of the air compressor system 100 with an application of a drilling rig may enter a drill pipe diameter, a drill bit diameter, and a desired up hole velocity (UHV) for the flushing air. The working air requirement can then be calculated as:

$$\text{Working Air Requirement}=D\times(B/1000^2-A/1000^2)/183.4. \qquad \text{Equation (1):}$$

Where A=drill pipe diameter, B=drill bit diameter, and D=desired UHV.

In embodiments, the working air requirement may be a desired working air pressure delivered to the working air outlet valve 36. In embodiments, the controller 22 may receive a desired working air pressure and an indication of the diameter of an accessory attached to the working air outlet valve 36. In embodiments, the controller 22 may receive a desired working air volume.

Optionally, the method may continue with calculating a setting for an output control of the air compressor to deliver the working air requirement 920. In embodiments, the output control of the air compressor may be an adjustable air inlet and/or an RPM of the engine and/or a clutch control between the engine and the air compressor.

The following is for the case when the output control of the air compressor is an adjustable air inlet. The setting for the adjustable air inlet (see element 12 of FIG. 1) of an air compressor is as follows. Calculate a maximum UHV that the air compressor system could deliver based on the user inputs as:

$$\text{Maximum UHV}=C\times 183.4/(B/1000^2-A/1000^2). \qquad \text{Equation (2)}$$

Where A=drill pipe diameter, B=drill bit diameter, and C=the maximum amount the air compressor system could deliver if the adjustable air inlet were opened completely.

From the above the percentage of the Maximum amount the air compressor system can be calculated as follows:

$$\text{Percentage of the Maximum}=\text{Working Air Requirement/ Maximum UHV.} \qquad \text{Equation (3):}$$

From the Percentage of the Maximum the controller 22 can calculate a setting for the adjustable inlet valve so that a Percentage of the Maximum air flows into the adjustable inlet valve. For example, the controller 22 can calculate the opening angle of a butterfly valve based on the extension of a linear actuator. See FIG. 5B for an example where:

$$\text{Angle}=ACOS(X\hat{}2+Y\hat{}2-(Y+Z)\hat{}2)/2XY. \qquad \text{Equation (4):}$$

Where X=bell crank length Y=actuator retracted length Z=actuator extension. From Equation (4), the controller 22 can set the actuator extension for a desired angle of the butterfly valve so that a Percentage of the Maximum air flows into the air compressor.

Therefore, a setting for the adjustable inlet valve may be calculated as the example above illustrates for the embodiment of the adjustable inlet valve of FIG. 5. In embodiments, the controller may calculate a setting for a number of RPMs for the engine or for a setting for a clutch.

The method optionally continues with adjusting the output control of the air compressor to the calculated setting 930. For example, for the embodiment of the adjustable air inlet valve of FIG. 5, the controller may set the linear actuator extension to a value so that the butterfly valve permits a Percentage of the Maximum air to flow into the air compressor. Thus, the air compressor system can make an initial setting of the adjustable inlet valve based on receiving a working air requirement. In embodiments, the controller may adjust a different output control of the air compressor. For example, the controller may set an RPM of the engine and/or the controller may set a clutch control.

In embodiments, the controller may adjust the adjustable air inlet to a value less than the calculated setting. For example, the linear actuator extension may be set to a value of fifty (50) percent of the calculated setting. This may have the advantage that when the drill hole is first started, the volume of air is less so that the rush of air from the drill bit does not blow the top of the hole away. The reduced calculated setting may be maintained only for a brief period of time or a brief distance of drilling. For example, only the first one (1) or two (2) meters of the drill hole. The distance of drilling may be detected by the depth sensor and/or by user input. In embodiments, the controller may set a different output control of the air compressor.

The method continues with calculating an estimated air pressure of the air compressor for the air compressor to deliver the working air requirement 940. The following example illustrates how the estimated air pressure of the air compressor may be calculated when the air pressure of the air compressor is measured at the air inlet (19 of FIG. 1) of the air compressor (20 of FIG. 1). Percentage of the Maximum may be calculated as in Equation (3) above. From the Percentage of the Maximum the estimated air pressure of the compressor can be calculated as follows:

$$\text{Estimated Air Pressure in Hg}=(-0.29\times(\text{Percentage of the Maximum}\times 100))+30. \qquad \text{Equation (5):}$$

From the Estimated Air Pressure in Hg a Estimated Pressure in milli-Amps (mA) from the pressure sensor (16A of FIG. 1) can be calculated as follows:

$$\text{Estimated Pressure in mA}=(0.533\times\text{Estimated Air Pressure in Hg})+4. \qquad \text{Equation (6):}$$

The Calculated Estimated Air Pressure of the Air Compressor in this example is the Estimated Pressure in Hg. In embodiments, the calculated estimated air pressure may be predetermined and stored so that the controller looks up an estimated air pressure value based on the received working air requirement. In embodiments, the calculated estimated air pressure may be adjusted to compensate for air leaks in the system and for other uses of the compressed air.

Therefore, as the above example illustrates an Estimated Air Pressure in Hg can be calculated and the pressure can be measured and transmitted to the controller.

The method optionally continues with has a predetermined amount of time elapsed 950. If the predetermined amount of time has elapsed then the method skips over the step of adjusting the adjustable inlet valve based on the calculated estimated air pressure. The predetermined amount of time may be a time period such as 10 seconds to several minutes. In embodiments, the predetermined amount of time may be long enough that the step of adjusting the adjustable inlet valve based on the calculated estimated air pressure is never skipped. If the predetermined amount of time has not elapsed then the method continues to comparing a measured pressure of the air compressor with the calculated estimated air pressure 960. The measured pressure of the air compressor may be in milli-amps when received by the controller and as demonstrated above the calculated estimated air pressure may be converted to a milli-amp reading.

If the measured pressure of the air compressor is less than the calculated estimated air pressure, then method continues with step 970. If the measured pressure of the air compressor is greater than the calculated estimated air pressure, then the method continues with step 980. In embodiments, the measured pressure of the air compressor must be less than the calculated estimated air pressure by a predetermined lesser amount for the method to continue with step 970. In embodiments, the measured pressure of the air compressor must be greater than the calculated estimated air pressure by a predetermined greater amount for the method to continue with step 980. By including a predetermined greater amount and a predetermined lesser amount the air compressor system may be less likely to fluctuate rapidly. For example, the predetermined greater amount could be 20% above the calculated estimated air pressure and the predetermined lesser amount could be 20% below the calculated estimated air pressure so that the air compressor system would be controlled with a band of plus or minus 20% of the calculated estimated air pressure. Adjusting the adjustable inlet valve based on a measured pressure of the air compressor has the advantage that measured pressure may be a more accurate indication of the actual volume of air delivered by the air compressor than setting an opening amount of the adjustable inlet valve. This may be for several reasons. The reasons include that temperature differences may make it difficult to set the adjustable inlet valve to a particular opening value and that the adjustable inlet valve may be difficult to calibrate.

In step 970 the controller increases the output control of the air compressor. In embodiments, the opening of the adjustable inlet valve is increased so that the air compressor system delivers more compressed air. The method then returns to step 950. In embodiments, the RPMs of the engine is increased. In embodiments, the control of a clutch between the engine and the air compressor is increased. In step 980 the opening of the output control of the air compressor is decreased. In embodiments, the opening of the adjustable inlet valve is decreased so that the air compressor system delivers less compressed air. In embodiments, the RPMs of the engine is decreased. In embodiments, the control of a clutch between the engine and the air compressor is decreased.

Step 960 continues to step 990 if the measured pressure of the air compressor is neither less than nor greater than the calculated estimated air pressure (with possibly a predetermined lesser amount and a predetermined greater amount). Step 990 is determining a delivered working air pressure. In embodiments, the determined delivered working air pressure may be determined by calculating a running average of a delivered working air pressure. An example of the delivered working air pressure is illustrated in FIG. 1 as the flushing air pressure sensor 16D. The delivered working air pressure may be measured in different places. The running average may be calculated over a predetermined period of time such as 10 seconds by repeatedly sampling the measured pressure of the delivered working air pressure regularly and then dividing by the number of samples after the predetermined period of time. Many other predetermined periods of time are possible such as 2 seconds and 10 minutes. Additionally, a running average could be calculated in many different ways. For example, three (3) readings of the delivered working air pressure could be taken and the middle reading of the three (3) reading could be used to compare with the working air requirement. As another example, the delivered working air pressure could be determined by monitoring the delivered working air pressure and if the working air pressure falls below a certain predetermined amount (for example, five (5) percent) below the working air requirement, then the value for the delivered working air pressure that is below five (5) percent may be used to determine whether or not to adjust the air compressor. In embodiments, readings of the delivered working air pressure that are either high or low may be ignored. In embodiments, readings of the delivered working air pressure are evaluated by the controller over a period of time and used to determine whether or not to adjust the delivered working air pressure.

After step 990, the method continues with comparing the determined delivered working air pressure with the working air requirement 995. The determined delivered working air pressure may be determined as explained above. In embodiments, the determined delivered working air pressure may be compared with the working air requirement by comparing the calculated running average with the working air requirement 995. The calculated running average may be compared with the Working Air Requirement (from Equation (1) and step 210 above). If the calculated running average is greater than the working air requirement then the method may continue to step 980. If the calculated running average is less than the working air requirement then the method may continue to step 970. In embodiments, if the calculated running average is greater than the working air requirement by a second predetermined greater amount then the method may continue to step 980. The second predetermined greater amount may be a fixed amount or a percentage of the working air requirement. In embodiments, if the calculated running average is less than the working air requirement by a second predetermined lesser amount then the method may continue to step 970. The second predetermined lesser amount may be a fixed amount or a percentage of the working air requirement. All of the predetermined amounts discussed above and below may be adjusted during the method continues to improve performance of the air compressor system. In embodiments, the controller may use the delivered working air pressure to determine whether or not to adjust the air compressor.

In embodiments, the working air requirement may change according to a depth of a drill bit. For example, the working air requirement may be increased by about 5% per 10 meters. The increased working air requirement may be needed to increase the flushing air to compensate for the greater depth of the drill hole. The depth of the drill bit may be determined from the depth sensor (16E of FIG. 1) or from user input from the input device. Additionally, the controller may re-calculate the calculated estimated air pressure if the working air requirement is changed according to a depth the drill bit. In embodiments, the working air requirement may be increased to compensate for leaks in the air compressor system. For example, a hose may have a leak.

If the method does not continue to either step 970 or step 980 then the method continues to optional step 997. Step 997 is comparing receiver pressure with maximum (max) and minimum (min) values. If the receiver pressure (for example element 16C of FIG. 1) is greater than a max (max may be 100 pounds per square inch (psi) for a low pressure operation and 550 psi for high power operation) then the method continues to step 980. If the receiver pressure (for example element 16C of FIG. 1) is less than a max (min may be 30 psi for a low pressure operation and 80 psi for high power operation) then the method continues to step 970. Otherwise the method continues back to step 950.

If the optional step 997 is not present then the method continues to step 950 from step 995 if the method does not continue to step 970 or step 980. The method may terminate for multiple reasons. Among the reasons the method may terminate are the controller may receive an indication that the working air is no longer required and/or the controller may receive an indication that the air compressor system is to be shut down. Thus, a method of controlling the air compressor system has been demonstrated.

In embodiments, steps 990 and 995 are optional. In embodiments, steps 960 995, and 997 may be in a different order. In embodiments, the method may not adjust the adjustable inlet valve in steps 980 and 970 until determining whether the adjustable inlet valve needs to be adjusted according to steps 960 and 995 and optionally step 997. The method may prioritize one or more of steps 960, 995 and 997 to determine whether or not to adjust the adjustable inlet valve. Alternatively, or in addition, the method may adjust the adjustable inlet valve based on the outcome of the comparisons in 960, 995, and optionally 997 based on a weight of how much of an adjustment is indicated in each of the comparisons.

In embodiments, step 980 may include comparing a delivered working air pressure to a minimum working air pressure and if the delivered working air pressure is not greater than the minimum working air pressure by a predetermined amount then not decreasing the output control of the air compressor. The minimum working air pressure may be a setting for maintaining a minimum amount of flushing air so that the drill bit is not damaged or stuck by the debris not being flushed out of the drill hole. In embodiments, step 980 may include comparing the measured pressure of the air compressor with a minimum pressure for a minimum working air, and if the measured pressure of the air compressor is not greater than the minimum pressure for a minimum working air pressure by a predetermined amount then not decreasing the output control of the air compressor. The minimum pressure for a minimum working air pressure may be a determined pressure for the air compressor to deliver the minimum working air pressure.

In embodiments, steps 970 and 980 may include adjusting a different output control of the air compressor. For example, a clutch control may be increased or decreased, and/or an RPM of the engine may be increased or decreased.

Figure 10:
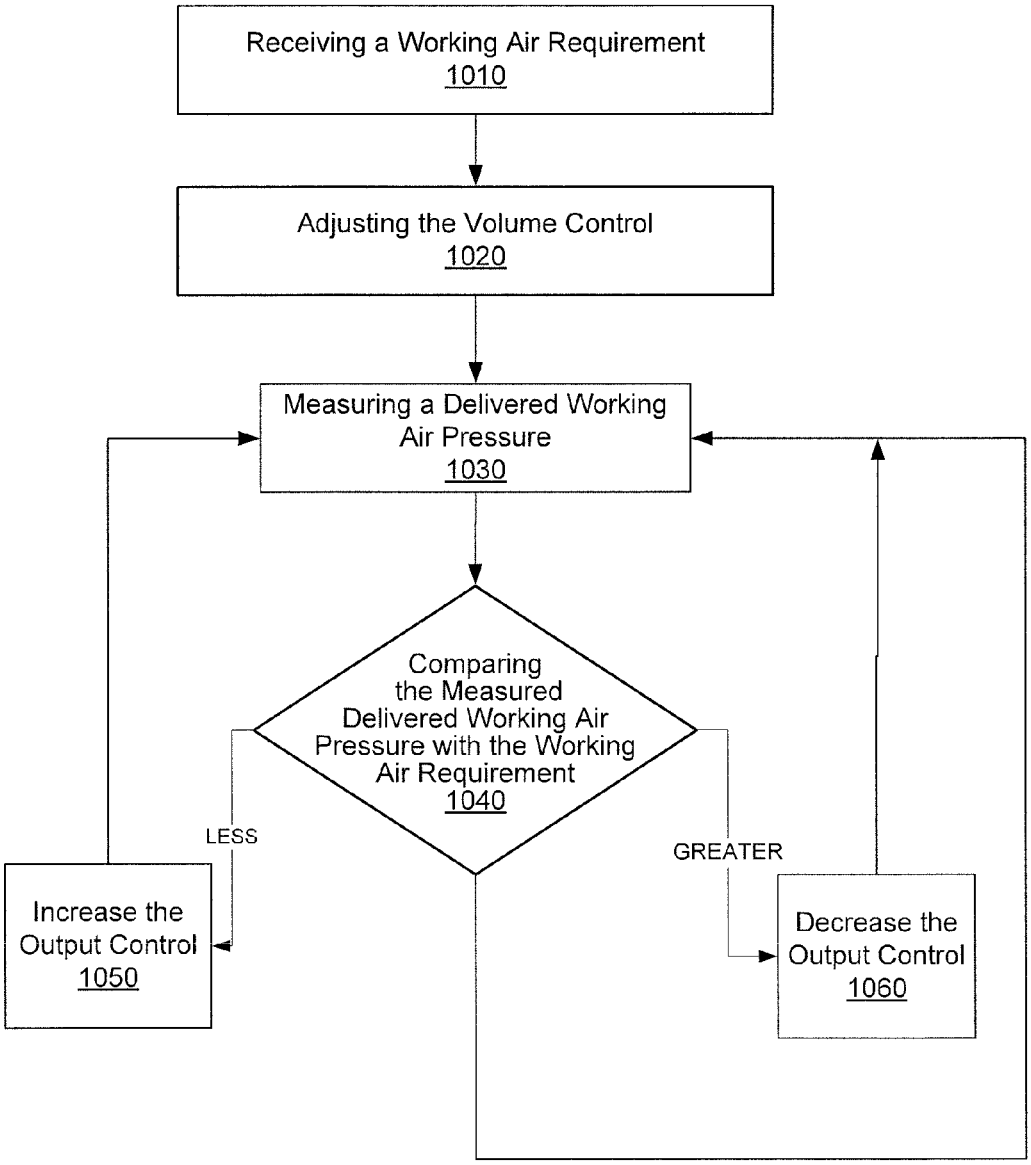
FIG. 10 illustrates an example of a method of controlling an air compressor system.

FIG. 10 illustrates an example of a method of controlling an air compressor system. The method begins with receiving a working air requirement 1010. A working air requirement may be received from the input device (not illustrated) of FIG. 1. As an example, the user of the air compressor system 100 with an application of a drilling rig may enter a drill pipe diameter, a drill bit diameter, and a desired up hole velocity (UHV) for the flushing air. The working air requirement can then be calculated as described above.

In embodiments, the working air requirement may be a desired working air pressure delivered to the working air outlet valve 36. In embodiments, the controller 22 may receive a desired working air pressure and an indication of the diameter of an accessory attached to the working air outlet valve 36. In embodiments, the working air requirement may change according to a depth of a drill bit. For example, the working air requirement may be increased by about five (5) % per ten (10) meters. The increased working air requirement may be needed to increase the flushing air to compensate for the greater depth of the drill hold. In embodiments, the working air requirement may change according to leaks in the system. For example, a hose may have leak in it so that the controller or a user input may adjust the working air requirement to compensation for the leak.

The method continues with adjusting the output control of the air compressor 1020. In embodiments, the output control of the air compressor may be an adjustable air inlet and/or an RPM of the engine and/or a clutch control between the engine and the air compressor. In embodiments, an adjustable air inlet may be adjusted to a predetermined opening for beginning to supply working air. In embodiments, an adjustable engine may be set to a predetermined RPMs. In embodiments, a clutch may be set to a predetermined setting.

Optionally, the method may include prior to step 1020 calculating a setting for an output control of the air compressor. For example, a setting for an adjustable air inlet of an air compressor to deliver the working air requirement may be calculated. The setting for the adjustable air inlet (see element 12 of FIG. 1) of an air compressor may be calculated as described above. In embodiments, an RPM for an engine that controls the air compressor is calculated. In embodiments, a setting for a clutch is calculated. As described above, in embodiments, the controller may adjust the output control of the air compressor to a value less than the calculated setting for a brief period of time or a brief distance of drilling.

The method continues with measuring a delivered working air pressure 1030. An example of the delivered working air pressure is illustrated in FIG. 1 as the flushing air pressure sensor 16D. The delivered working air pressure may be measured in different places including at or near where the working air is delivered. A running average may be calculated for the delivered working air pressure as discussed above. Additionally, a running average could be calculated in many different ways. For example, three (3) readings of the delivered working air pressure could be taken and the middle reading of the three (3) reading could be used to compare with the working air requirement. As another example, the delivered working air pressure could be determined by monitoring the delivered working air pressure and if the working air pressure falls below a certain predetermined amount (for example, five (5) percent) below the working air requirement, then the value for the delivered working air pressure that is below five (5) percent may be used to determine whether or not to adjust the air compressor. In embodiments, readings of the delivered working air pressure that are either high or low may be ignored. In embodiments, readings of the delivered working air pressure are evaluated by the controller over a period of time and used to determine whether or not to adjust the delivered working air pressure.

The method continues with comparing the measured delivered working air pressure with the working air requirement 1040. If the measured delivered working air pressure is greater than the working air requirement then the method may continue to step 1060. If the measured delivered working air pressure is less than the working air requirement then the method may continue to step 1050. In embodiments, the comparison may be to determine whether the measured delivered working air pressure and the working air requirement are within a predetermined amount to determine whether or not to adjust the adjustable air inlet valve.

In embodiments, step 1040 may include comparing the measured delivered working air pressure to a minimum working air pressure and if the measured delivered working air pressure is not greater than the minimum working air pressure by a predetermined amount then not decreasing the output control of the air compressor. The minimum working air pressure may be a setting for maintaining a minimum amount of flushing air so that the drill bit is not damaged or stuck by the debris not being flushed out of the drill hole.

If the method does not continue to either step 1050 or step 1060 then the method may return to 1030. Steps 1050 and 1060 adjust an output control of the air compressor. For example, the controller may adjust may set an RPM of the engine and/or the controller may set a clutch control and/or the controller may set an opening of an adjustable inlet valve.

Optionally, the method may include the following steps: calculating an estimated air pressure of the air compressor for the air compressor to deliver the working air requirement, measuring a pressure of the air compressor, and, comparing the measured pressure of the air compressor with the calculated estimated air pressure. These steps and the corresponding steps to adjust the output control of the air compressor may be implemented as discussed above.

Optionally, the method may include comparing receiver pressure with maximum (max) and minimum (min) values. This step and the corresponding steps to adjust the adjustable air inlet valve may be implemented as discussed above.

The method may terminate for multiple reasons. Among the reasons the method may terminate are the controller may receive an indication that the working air is no longer required and/or the controller may receive an indication that the air compressor system is to be shut down. Thus, a method of controlling the air compressor system has been demonstrated.

The term calculate includes looking up values in a table that may have been pre-loaded or pre-calculated as well as other forms of acquiring a calculated quantity that does not involve expressly calculating the quantity, but may involve retrieving the quantity from a storage location that may either be local or remote.

Embodiments of the invention may be embodied as kits for upgrading existing air compressor systems. The upgrade kits may include parts for upgrading an existing air compressor system. The parts may include any of the parts described above and embodiments of the methods described above in the forms described below such as a computer readable medium or a ROM memory. Additionally, the kits may include instructions for upgrading existing air compressor systems to embodiments of the invention described above and may include instructions for downloading an embodiment of a method described above from the Internet and/or from a remote or local computer.

Although the explanation above was limited to drilling rigs, it should be understood that the disclosed air compressor system and methods of operation thereof are not limited to drilling rigs and may be used in many other applications.

Although additions have been made to this disclosure, these additions should not be construed to limit the previous disclosure as not including the additions.

The various illustrative logics, logical blocks, modules, and circuits described in connection with the embodiments disclosed herein may be implemented or performed with a general purpose processor, a digital signal processor (DSP), an application specific integrated circuit (ASIC), a field programmable gate array (FPGA), a programmable logic controller (PLC) or other programmable logic device, discrete gate or transistor logic, discrete hardware components, or any combination thereof designed to perform the functions described herein. A general-purpose processor may be a microprocessor, but, in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

Further, the steps and/or actions of a method or algorithm described in connection with the controller 22 disclosed herein may be embodied directly in hardware, in a software module executed by a processor, or in a combination of the two. A software module may reside in RAM memory, flash memory, ROM memory, EPROM memory, EEPROM memory, registers, a hard disk, a removable disk, a CD-ROM, or any other form of storage medium known in the art. An exemplary storage medium may be coupled to the processor, such that the processor can read information from, and write information to, the storage medium. In the alternative, the storage medium may be integral to the processor. Further, in some aspects, the processor and the storage medium may reside in an ASIC. Additionally, the ASIC may reside in a user terminal. In the alternative, the processor and the storage medium may reside as discrete components in a user terminal. Additionally, in some aspects, the steps and/or actions of a method or algorithm may reside as one or any combination or set of instructions on a machine readable medium and/or computer readable medium.

The computer readable recording medium can also be distributed over network coupled computer systems so that the computer readable code is stored and executed in a distributed fashion. The computer readable recording medium may be limited to non-transitory computer readable recording medium.

Although described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. A method of controlling an air compressor, the method comprising:

in response to a working air being turned on, measuring a working air pressure with a first sensor, adjusting an output control of the air compressor based on the measured working air pressure, and cooling the air compressor by providing a supply of oil to cooling lines of the air compressor via an oil line between a receiver and the air compressor; and in response to the working air being turned off, measuring a receiver air pressure with a second sensor, adjusting the output control of the air compressor based on the measured receiver air pressure, the receiver configured to store air compressed by the air compressor, and stopping the supply of oil to cooling lines of the air compressor by stopping a flow of oil in the oil line between the receiver and the air compressor, wherein the first sensor is downstream from the second sensor and is isolatable from the second sensor by a valve.

2. The method of claim 1, wherein adjusting an output control of the air compressor based on the measured working air pressure, comprises:

adjusting at least one of: an opening of an adjustable inlet valve, an RPM of an engine, and a clutch control based on the measured working air pressure; and wherein adjusting the output control of the air compressor based on the measured receiver air pressure, comprises:

adjusting at least one of: an opening of an adjustable inlet valve, an RPM of an engine, and a clutch control based on the measured receiver air pressure, the receiver configured to store air compressed by the air compressor.

3. The method of claim 1, further comprising:

in response to receiving a working air requirement, calculating a setting for the output control of the air compressor based on the working air requirement, and adjusting the output control of the air compressor using the calculated setting.

4. The method of claim 1, further comprising:

in response to receiving a working air requirement, calculating an air pressure for an air inlet of the air compressor based on the working air requirement, measuring the air pressure for the air inlet of the air compressor, and adjusting the output control of the air compressor based on the calculated air pressure and the measured air pressure.

5. The method of claim 1, wherein measuring the working air pressure comprises: measuring the working air pressure by determining a running average of the working air pressure.

6. The method of claim 1, wherein cooling the air compressor includes opening a valve in the oil line between the receiver and the air compressor.

7. The method of claim 6, wherein the valve in the oil line responds to air pressure at an air outlet of the air compressor.

8. The method of claim 6, wherein stopping the supply of oil to cooling lines of the air compressor includes closing the valve in the oil line between the receiver and the air compressor.

9. The method of claim 1, further comprising adjusting a working air requirement based on a depth of a drill bit.

10. A computer program product, comprising:

a non-transitory computer-readable medium comprising:

a first set of codes for causing a computer to measure a working air pressure in response to a working air being turned on;

a second set of codes for causing a computer to adjust an output control configured to control an amount of air compressed by an air compressor based on the measured working air pressure;

a third set of codes for causing a computer to measure a receiver air pressure in response to the working air being turned off; and a fourth set of codes for measuring a receiver air pressure and adjusting the output control of the air compressor based on the measured receiver air pressure, the receiver configured to store air compressed by the air compressor, wherein the working air pressure is measured by a first sensor that is downstream from a second sensor that measures the receiver air pressure and wherein the first sensor is isolatable from the second sensor by a valve, and wherein, based on air pressure at the air outlet of the air compressor, cooling of the air compressor by providing a supply of oil to cooling lines of the air compressor via an oil line between a receiver and the air compressor is initiated and stopped.

* * * * *